US012017106B2

(12) United States Patent
Yang

(10) Patent No.: US 12,017,106 B2
(45) Date of Patent: Jun. 25, 2024

(54) FITNESS EXERCISE APPARATUS

(71) Applicant: YANGZHOU JIUYI HARDWARE & MACHINERY CO., LTD., Jiangsu (CN)

(72) Inventor: Yen-Shuo Yang, Taichung (TW)

(73) Assignee: Yangzhou Jiuyi Hardware & Machinery Co., Ltd., Yangzhou (CN)

( * ) Notice: Subject to any disclaimer, the term of this patent is extended or adjusted under 35 U.S.C. 154(b) by 125 days.

(21) Appl. No.: 17/970,913

(22) Filed: Oct. 21, 2022

(65) Prior Publication Data

US 2024/0131382 A1 Apr. 25, 2024

(51) Int. Cl.
*A63B 21/055* (2006.01)
*A63B 21/00* (2006.01)

(52) U.S. Cl.
CPC ..... *A63B 21/0552* (2013.01); *A63B 21/154* (2013.01); *A63B 21/4035* (2015.10)

(58) Field of Classification Search
CPC ..... A63B 21/0552; A63B 21/154; A63B 21/4035
See application file for complete search history.

(56) References Cited

U.S. PATENT DOCUMENTS 7,815,552 B2 * 10/2010 Dibble ..... A63B 21/154 482/92
8,057,368 B1 * 11/2011 Lyszczarz ..... A63B 21/0628 482/142
11,338,168 B2 * 5/2022 Yang ..... A63B 21/0552
2002/0077229 A1 * 6/2002 McBride ..... A63B 23/035 482/130
2007/0135272 A1 * 6/2007 Stuckey ..... A63B 21/154 482/99
2007/0270293 A1 * 11/2007 Zhuang ..... A63B 21/4029 482/121
2021/0361997 A1 * 11/2021 Yang ..... A63B 21/0552
2022/0379158 A1 * 12/2022 Harwerth ..... A63B 21/4033
2023/0118879 A1 * 4/2023 Yang ..... A63B 21/0442 482/138
2023/0124790 A1 * 4/2023 Yang ..... A63B 21/4043 482/94

* cited by examiner

*Primary Examiner* — Andrew S Lo
(74) *Attorney, Agent, or Firm* — Burris Law, PLLC

(57) ABSTRACT

A fitness exercise apparatus includes a main frame, a seat unit, a first elastic unit, two second elastic units, a transmission unit, and an operating unit. The main frame includes a base seat and a support unit. The seat unit is mounted detachably on the base seat. The first elastic unit is mounted on the main frame and includes a plurality of first elastic members. The two second elastic units are mounted on the main frame and includes a plurality of second elastic members. The transmission unit includes a first fixed pulley set, a second fixed pulley set, a main movable pulley set, two third fixed pulley sets, two side movable pulley sets, a first cable, a second cable, and two third cables. The operating unit includes an operating member that is connected to one of the first, second and third cables.

9 Claims, 21 Drawing Sheets

FITNESS EXERCISE APPARATUS

FIELD

The disclosure relates to an exercise machine, and more particularly to a fitness exercise apparatus.

BACKGROUND

A conventional exercise machine such as the one disclosed in US Patent Application Publication No. US 2002/0077229 A1 includes a frame assembly, a user support assembly connected to the frame assembly, two bungee cord units mounted on the frame assembly, and two cable units respectively connected to the two bungee cord units. When the conventional exercise machine is used, a user sits on the user support assembly and pulls the cable units which pulls the bungee cord units, and elastic deformation of the bungee cords provides resistance for the user to train against.

However, the bungee cords in the conventional exercise machine are wrapped over a pulley and the contact between the bungee cords and the pulley generates friction that greatly reduces the service life of the bungee cords. Additionally, the user will have a comparatively more limited range of movement when performing exercises on the conventional exercise machine since the length of travel for the bungee cords and the cables are fixed.

Moreover, the conventional exercise machine has complicated cable connections underneath a seat unit of the user support assembly, this design complicates procedures for detaching the seat unit from the conventional exercise machine.

SUMMARY

Therefore, an object of the disclosure is to provide a fitness exercise apparatus that can alleviate at least one of the drawbacks of the prior art.

According to the disclosure, the fitness exercise apparatus includes a main frame, a seat unit, a first elastic unit, two second elastic units, a transmission unit, and an operating unit. The main frame includes a base seat and a support unit that is connected to the base seat. The seat unit is mounted detachably on the base seat. The first elastic unit is mounted on the main frame and includes a plurality of first elastic members. The two second elastic units are mounted on the main frame, and each of the second elastic units includes a plurality of second elastic members. The transmission unit includes a first fixed pulley set, a second fixed pulley set, a main movable pulley set, two third fixed pulley sets, two side movable pulley sets, a first cable, a second cable, and two third cables. The first fixed pulley set, the second fixed pulley set, and the two third fixed pulley sets are mounted on the support unit. The two side movable pulley sets are connected respectively to the second elastic units. The first cable wraps around the first fixed pulley set and the main movable pulley set. The second cable wraps around the second fixed pulley set and the main movable pulley set, and is connected to the first elastic unit. Each of the two third cables wraps around a respective one of the third fixed pulley sets and a respective on of the side movable pulley sets. The operating unit includes at least one operating member that is connected to one of the first, second and two third cables. Pulling of the first cable drives the main movable pulley set to move upwardly, thereby resulting in, via the second cable, deformation of the first elastic unit against an elastic force of the first elastic unit. Pulling of each of the third cables drives the respective one of the side movable pulley sets to move upwardly, thereby resulting in deformation of the respective one of the second elastic units against an elastic force of the second elastic unit.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
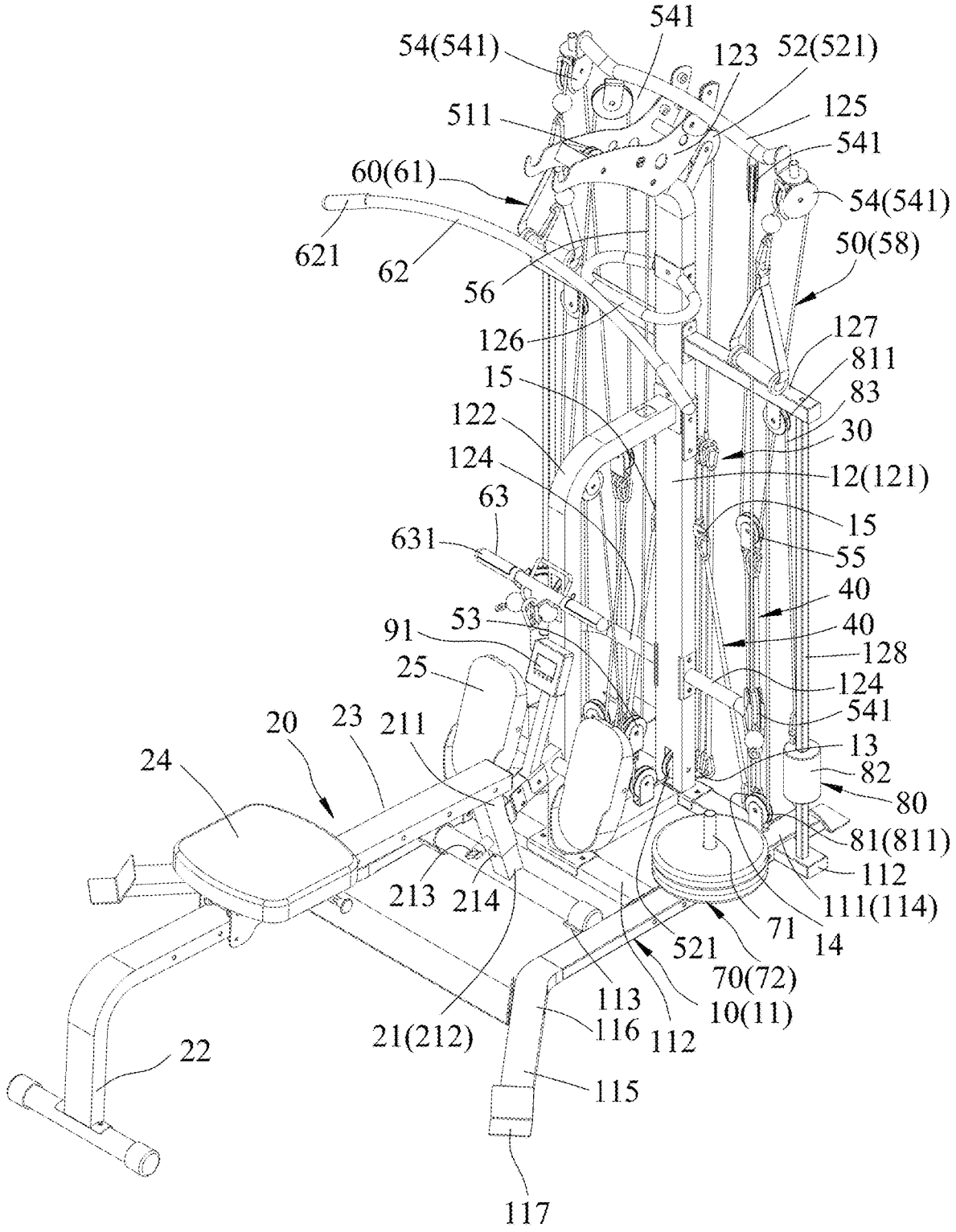
FIG. 1 is a perspective view illustrating an embodiment of a fitness exercise apparatus according to the present disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
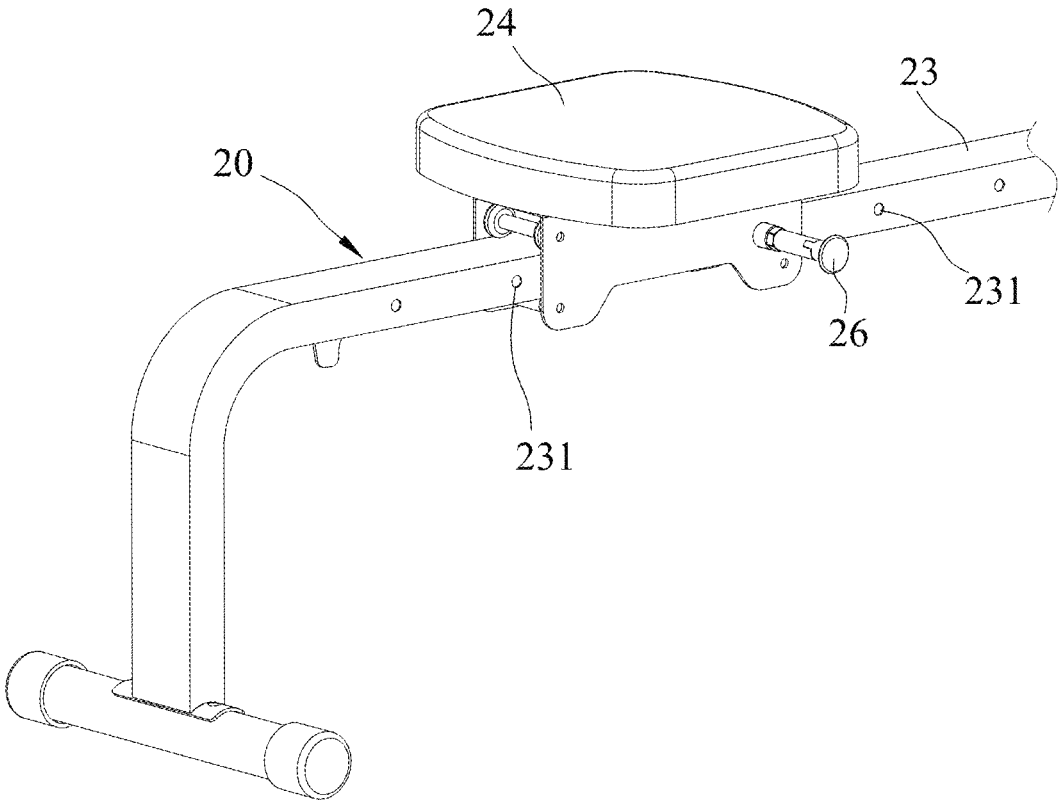
FIG. 2 is a fragmentary perspective view illustrating a seat unit of the embodiment.
Figure 5:
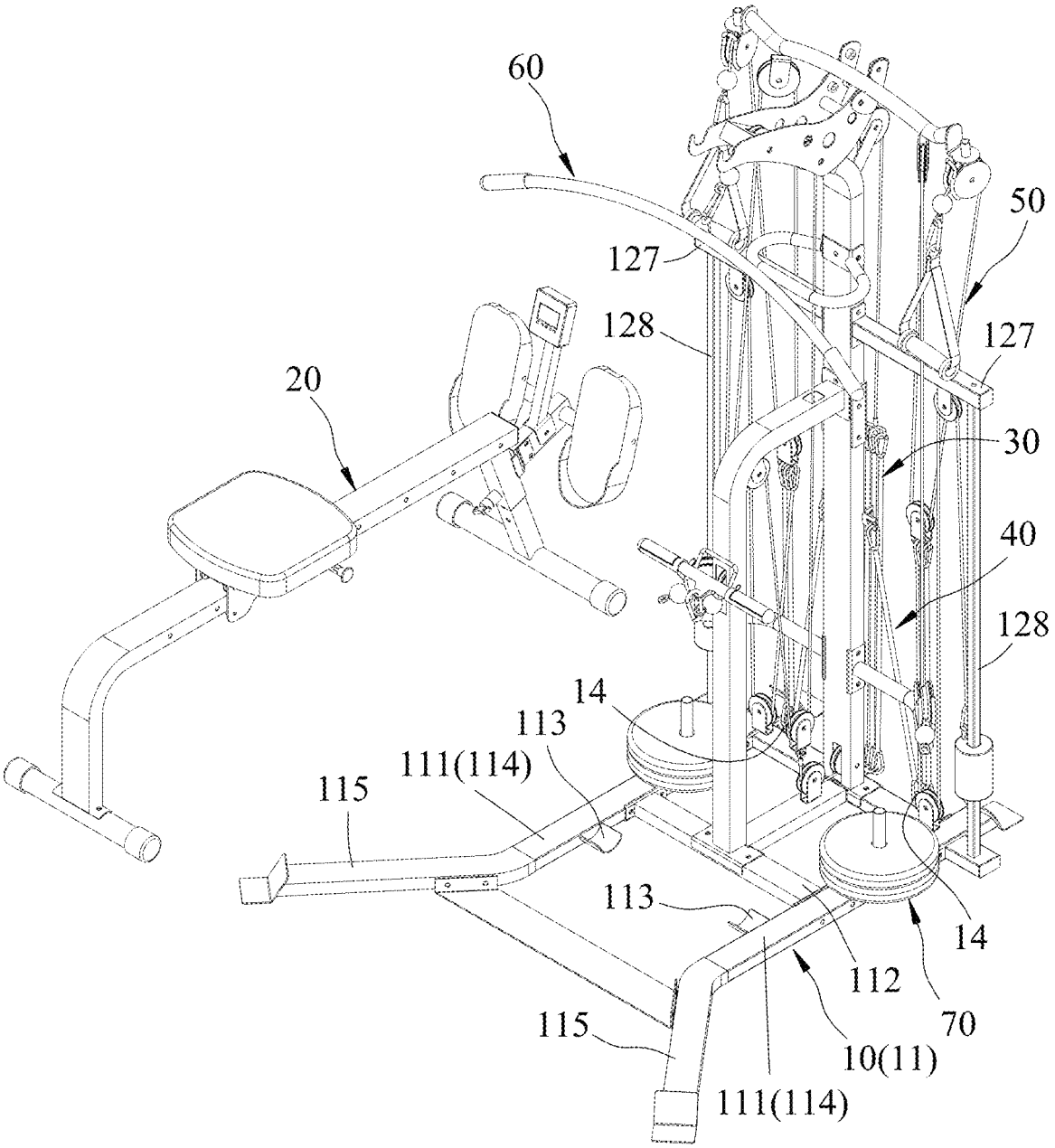
FIG. 5 is a perspective view showing the seat unit detached from the embodiment.

Referring to FIGS. 1, 2 and 5, an embodiment of the fitness exercise apparatus according to the disclosure includes a main frame 10, a seat unit 20, a first elastic unit 30, two second elastic units 40, a transmission unit 50, an operating unit 60, two weight units 70, and two resistance units 80.

The main frame 10 includes a base seat 11, a support unit 12 that is connected to the base seat 11, a first hanger-board 13 that corresponds in position with the support unit 12, two second hanger-boards 14 that are mounted to the base seat 11, and two third hanger-boards 15 mounted to the support unit 12.

The base seat 11 includes two spaced-apart legs 111, a plurality of connecting rods 112 that are connected between the legs 111, and two retaining members 113. Each of the legs 111 of the base seat 11 has a base segment 114 and an inclined segment 115 that is transverse to the base segment 114, that has an inner end 116 connected to the base segment 114, and an outer end 117 opposite to the inner end 116. A distance between the inclined segments 115 of the legs 111 gradually increases from the inner ends 116 of the inclined segments 115 towards the outer ends 117 of the inclined segments 115. The retaining members 113 are half-round gutter shaped, are respectively connected fixedly to the base segments 114 of the legs 111, and are respectively proximate to the inclined segments 115 of that legs 111. The second hanger-boards 14 are mounted on one of the connecting rods 112.

The support unit 12 of the main frame 10 includes a rear support member 121, a front support member 122, a hanging member 123, two lower mounting rods 124, an upper mounting rod 125, a support handle 126, two horizontal rods 127, and two guide rods 128. The rear support member 121 is inverted L-shaped and mounted to one of the connecting rods 112. The front support member 122 is connected between the rear support member 121 and another one of the connecting rods 112 of the base seat 11, and is also inverted L-shaped. The hanging member 123 is mounted on top of the rear support member 121. The two lower mounting rods 124 are connected respectively to opposite lateral sides of the rear support member 121. The upper mounting rod 125 is mounted on the hanging member 123. The support handle 126 is mounted to the rear support member 121. The two horizontal rods 127 are connected respectively to the opposite lateral sides of the rear support member 121. Each of the two guide rods 128 has one end that is connected to the base seat 11, and an opposite end that is connected to a respective one of the horizontal rods 127. The two third hanger-boards 15 of the main frame 10 are mounted respectively to the opposite lateral sides of the rear support member 121.

Figure 3:
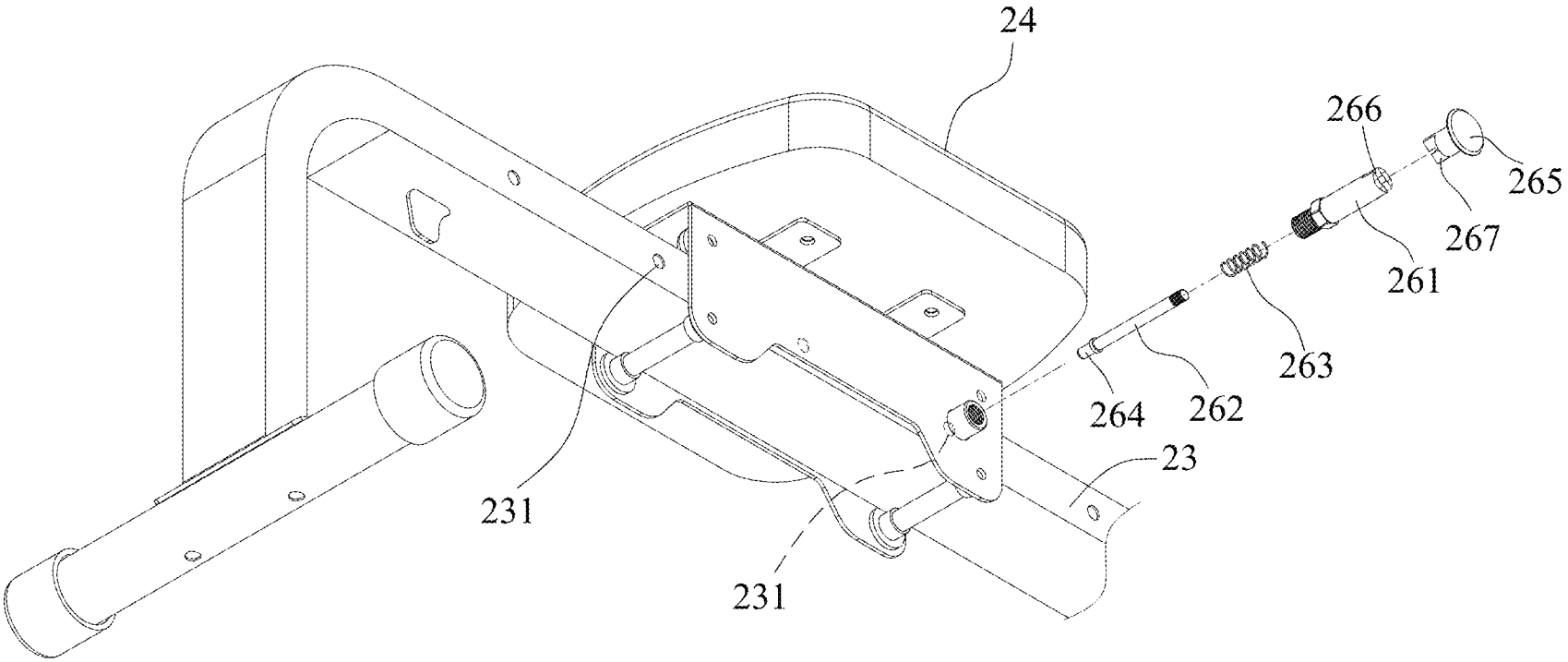
FIG. 3 is a fragmentary partially exploded perspective view illustrating the seat unit.
Figure 6:
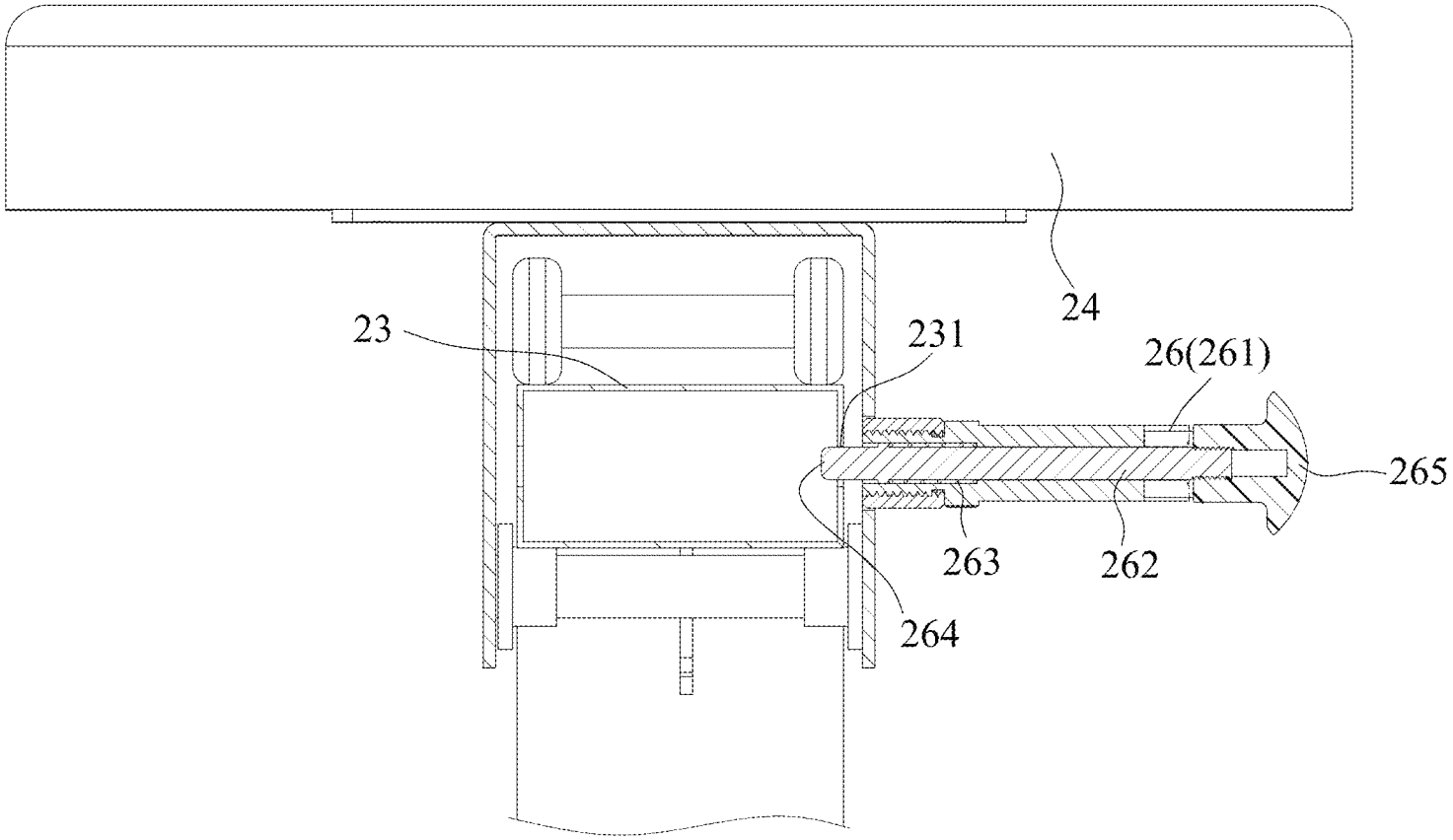
FIG. 6 is a fragmentary partially sectional view illustrating the seat unit.

The seat unit 20 is mounted detachably on the base seat 11, and includes an inner leg member 21, an outer leg member 22, a guide rail 23, a seat member 24, two foot rests 25, and a latch unit 26. The inner leg member 21 is coupled removably to the retaining members 113. The guide rail 23 is connected between the inner leg member 21 and the outer leg member 22. The seat member 24 is mounted on the guide rail 23, the foot rests 25 are secured to the inner leg member 21, and the latch unit 26 is mounted to the seat member 24. The inner leg member 21 includes a stationary tube 211, an inner leg rod 212, and an adjusting component 213. The stationary tube 211 is connected transversely to the guide rail 23. The inner leg rod 212 is inverted T-shaped, and has two arms coupled removably and respectively to the retaining members 113 of the base seat 11. Moreover, the inner leg rod 212 is connected telescopically to the stationary tube 211 and is formed with a plurality of adjusting holes 214. The adjusting component 213 is inserted transversely into the stationary tube 211 and engages a selected one of the adjusting holes 214. Referring to FIGS. 3 and 6, the seat member 24 is capable of sliding relative to the guide rail 23 or capable of being securely affixed to the guide rail 23 via the latch unit 26. More specifically, the guide rail 23 has a plurality of securing holes 231 arranged lengthwise. The latch unit 26 has a latch pin 262, an outer sleeve 261 that is sleeved over the latch pin 262 and that has a groove 266, and a spring 263 that is sleeved on the latch pin 262 and that is disposed between the latch pin 262 and the outer sleeve 261. The latch pin 262 has a latch end 264 that can engage a selected one of the securing holes 231 of the guide rail 23 to securely fix the seat member 24 to the guide rail 23. The latch unit 26 further has a pull knob 265 opposite to the latch end 264 of the latch pin 262. The spring 263 biases the latch end 264 of the latch pin 262 against the guide rail 23, so that the latch pin 262 can remain securely engaged to the selected one of the securing holes 231 of the guide rail 23 when the latch end 264 of the latch pin 262 engages that securing hole 231. The pull knob 265 is connected fixedly to the latch pin 262, and has an index portion 267 that is registered with the groove 266 of the latch pin 262. When the seat member 24 is securely fixed to the guide rail 23 via the latch unit 26, and the index portion 267 of the pull knob 265 engages the groove 266 of the latch pin 262. The pull knob 265 can then be pulled to disengage the index portion 267 from the groove 266, and the pulling back of the pull knob 265 disengages the latch end 264 of the latch pin 262 from the securing hole 231 of the guide rail 23. At this moment, the pull knob 265 can be rotated 90 degrees so that the latch end 264 remains disengaged from the securing hole 231 by preventing the index portion 267 from engaging the groove 266 of the latch pin 262, thereby facilitating sliding movement of the seat member 24 relative to the guide rail 23.

The first elastic unit 30 is mounted on the main frame 10 and includes a plurality of first elastic members 31. Each of the first elastic members 31 has an end hooked on the first hanger board 13, and an opposite end connected to the transmission unit 50.

The two second elastic units 40 are mounted on the main frame 10. Each of the second elastic units 40 is connected between a respective one of the second hanger-boards 14 and a respective one of the transmission units 50, and includes a plurality of second elastic members 41 (bungees). For each of the second elastic units 40, each of the second elastic members 41 has an end that is hooked on the respective one of the second hanger boards 14, and an opposite end that is connected removably to the respective one of the transmission units 50. When a second elastic member 41 is not in use it may be stored away by having the opposite end hooked on a respective one of the third hanger boards 15.

Figure 4:
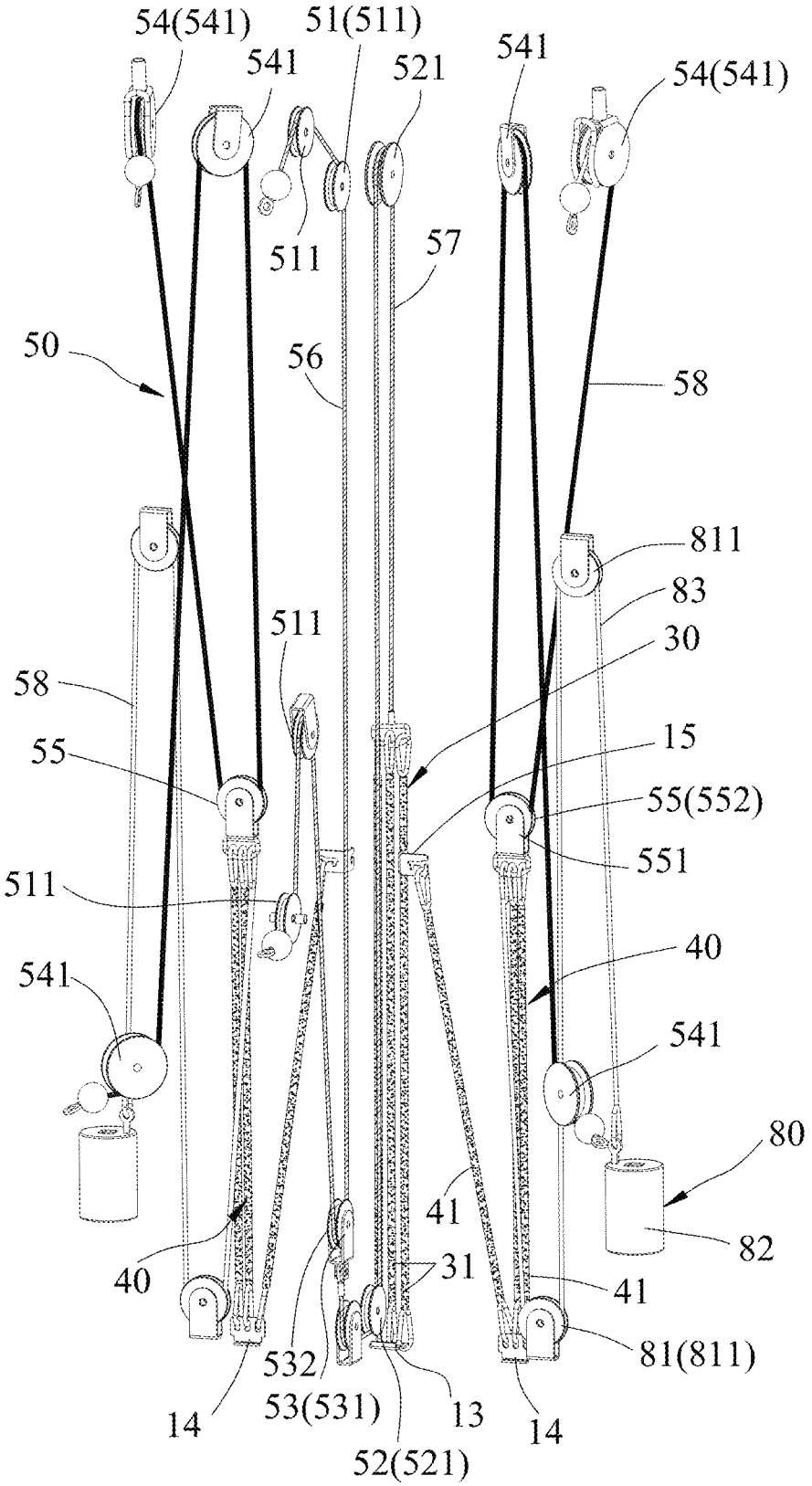
FIG. 4 is a schematic perspective view showing a transmission unit of the embodiment.

Referring to FIGS. 1 and 4, the transmission unit 50 includes a first fixed pulley set 51, a second fixed pulley set 52, a main movable pulley set 53, two third fixed pulley sets 54, two side movable pulley sets 55, a first cable 56, a second cable 57, and two third cables 58. The first fixed pulley set 51 and the second fixed pulley set 52 are mounted on the support unit 12. The two third pulley sets 54 are also mounted on the support unit 12. The two side movable pulley sets 55 are connected respectively to the second elastic units 40. The first cable 56 wraps around the first fixed Pulley set 51 and the main movable pulley set 53. The second cable 57 wraps around the second fixed pulley set 52 and the main movable pulley set 53, and is connected to the first elastic unit 30. The two third cables 58 each wrap around a respective one of the third fixed pulley sets 54 and a respective one of the side movable pulley sets 55.

The first fixed pulley set 51 includes a plurality of first fixed pulleys 511 that are mounted to the rear support member 121, the front support member 122, and the hanging member 123. The second fixed pulley set 52 includes a plurality of second fixed pulleys 521 that are mounted respectively to the rear support member 121 and the base seat 11. The main movable pulley set 53 includes a main block 531, and a main movable pulley 532 fixed on the main block 531. The first cable 56 wraps around the main movable pulley 532, and the second cable 57 is connected to the main block 531. The third fixed pulley set 54 includes a plurality of third fixed pulleys 541 mounted on the upper mounting rod 125 and the lower mounting rods 124. Each of the side movable pulley sets 55 of the transmission unit 50 includes a side block 551 and a side movable pulley 552 that is fixed on the side block 551. For each of the second elastic units 40, all the second elastic members 41 are connected detachably to the side block 551 of the respective one of the side movable pulley sets 55.

The operating unit 60 includes at least one operating member that is connected to one of the first, second and two third cables 56, 57, 58. In this embodiment, the operating unit 60 includes a plurality of operating members that are configured as two hand grips 61, a long handlebar 62 or a short handlebar 63. In practical terms, the two hand grips 61 may be respectively detachably connected to opposite first and second ends of the third cables 58. In this embodiment, the long handlebar 62 is detachably connected to a first end of the first cable 56, and the short handlebar 63 is detachably connected to a second end of the first cable 56. It should be noted that the operating members are not limited to the above examples, and they may be any device the user may use to operate the fitness exercise apparatus, for example, ankle straps, lat pulldown attachment, triceps rope, rotating bar, V-shaped bar etc.

The offset weight units 70 each include a shaft 71 that is secured to the base segment 114 of a respective one of the two space-apart legs 111 of the base seat 11, and a plurality of weight plates 72 that are sleeved removably on the shaft 71.

Each of the resistance units 80 includes a fourth fixed pulley set 81 that is mounted on the main frame 10, a weight block 82 that is mounted on the main frame 10 by being sleeved on a corresponding guide rod 128, and a connecting cable 83. For each resistance unit 80, the fourth fixed pulley set 81 includes two fourth fixed pulleys 811 mounted respectively on a respective one of the horizontal rods 127 and the base seat 11, and the connecting cable 83 wraps around the fourth fixed pulleys 811 and is interconnecting the side block 551 of a respective one of the side movable pulley sets 55 and the weight block 82. Specifically, the connecting cable 83 has one end connected to the side block 551 of the respective one of the side movable pulley sets 55, and an opposite end connected detachably to the weight block 82.

Referring to FIG. 1, when a user wishes to begin using the fitness exercise apparatus the inner leg member 21 is first coupled to the retaining members 113, and the seat member 24 may be selected, according to the type of training the user wishes to perform, to either slide against or be securely affixed to the guide rail 23 via the latch unit 26 in this embodiment. The number of the first and second elastic members 31, 41 may be selected according to the type of training the user wishes to conduct. The surplus first and second elastic members 31, 41 that are not in use may be stored. Surplus first elastic members 31 may be stored by having one end connected to the first hanger-board 13 and the other end connected to a nearest third hanger-board 15. Surplus second elastic members 41 may be stored by having one end connected to the respective second hanger-board 14 and the other end connected to a nearest third hanger-board 15.

Figure 7:
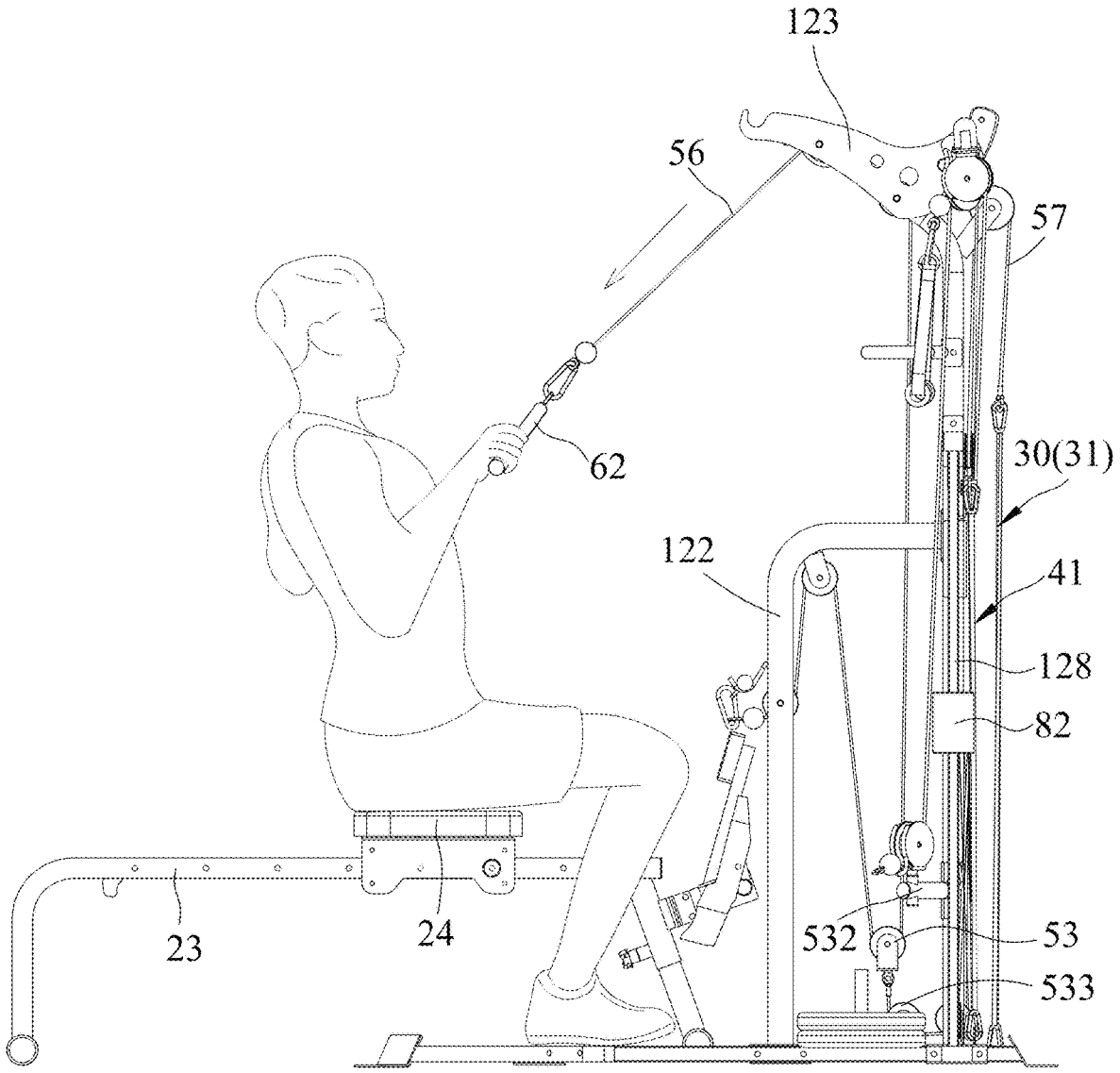
FIG. 7 is a schematic side view showing a user performing a wide grip lat pulldown exercise on the embodiment.

Referring to FIG. 7, when the seat member 24 is securely affixed relative to the guide rail 23 and the user is seated on the seat member 24, the user may pull the long handlebar 62 downwards, and the pulling of the first cable 56 drives the main movable pulley set 53 to move upwardly, thereby resulting in, via the second cable 57, deformation of the first elastic unit 30 against an elastic force of the first elastic unit 30. The above setup allows the user to perform a wide grip lat pulldown exercise as shown in FIG. 7, where the user is shown seated facing the fitness exercise apparatus. The same setup also allows the user to perform a wide grip rear pulldown exercise (not shown in the Figures) by sitting in a reverse position with their back facing the fitness exercise apparatus.

Figure 8:
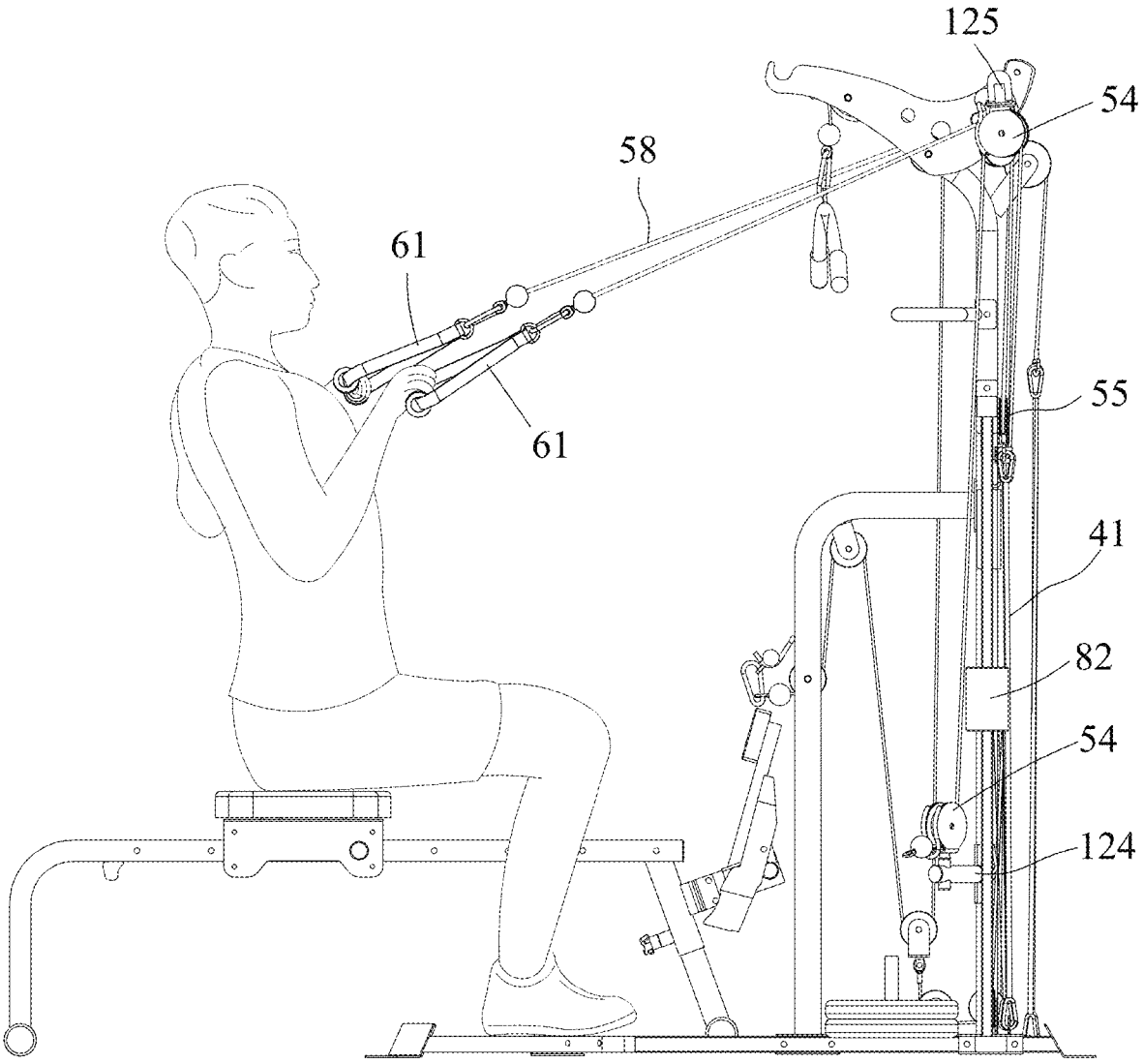
FIG. 8 is a schematic side view showing the user performing a chest pull exercise on the embodiment.

Referring to FIGS. 8, the user is shown performing a chest pull exercise on the fitness exercise apparatus. In this case, referring further to FIGS. 1 and 4, the fitness exercise apparatus is set up by connecting the two hand grips 61 respectively to the first ends of the third cables 58. The second ends of the third cables 58 are fixed at this time, so that when the user pulls the two hand grips 61, the pulling of each of the third cables 58 drives the respective one of the side movable pulley sets 55 to move upwardly, thereby resulting in movement of the weight block 82 of the respective one of the resistance units 80. In the meantime, the pulling of each of the third cables 58 results in deformation of the respective one of the second elastic units 40 against an elastic force of the second elastic unit 40. It should be noted, that a seated straight arm pulldown exercise may be performed from the same setup of the fitness exercise apparatus.

Figure 9:
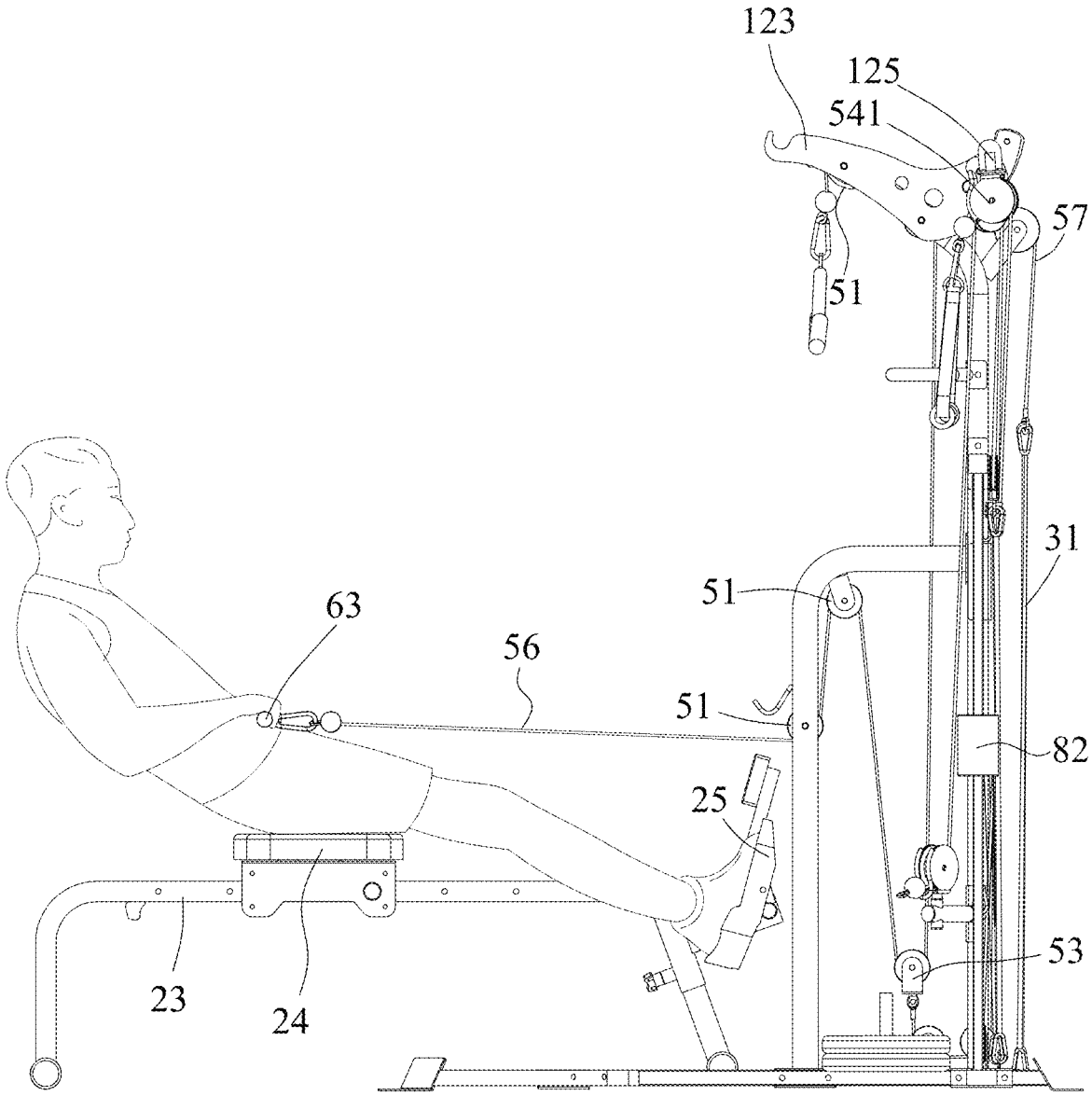
FIG. 9 is a schematic side view illustrating the user performing a seated cable row on the embodiment.

Referring to FIG. 9, a seated cable row exercise may be performed on the fitness exercise apparatus. In this case, the fitness exercise apparatus is set up by operating the latch unit 26 so that the seat member 24 is capable of sliding relative to the guide rail 23. The user is seated on the seat member 24 and has both feet planted on the foot rests 25. In this exercise, the user pulls the short handle bar 63 while seated on the seat member 24 and sliding relative to the guide rail 23. The first end of the first cable 56 is fixed to prevent movement, so that resistance against the user's pull from the first elastic member 31 can be transferred via the first cable 56. The seated cable row exercise allows the user to effectively train the latissimus dorsi muscles and the trapezius muscles.

Figure 10:
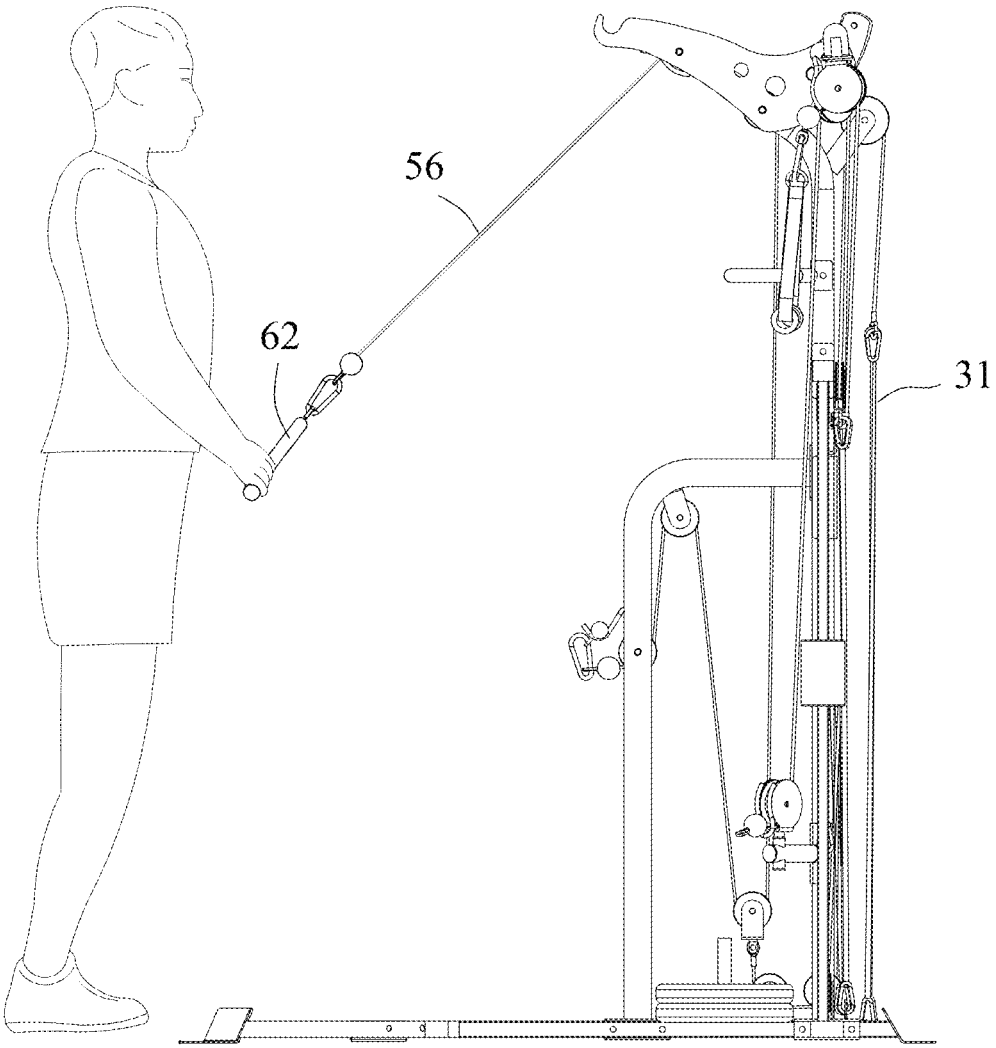
FIG. 10 is a schematic side view illustrating the user performing a triceps pushdown exercise on the embodiment.

Referring to FIG. 10, the seat unit 20 may be detached from the main frame 10 to allow the user to perform a triceps push down exercise. In this case, the user is standing and uses the long handlebar 62 to pull down against the resistance of the resistance unit 30. The setup is similar to the wide grip lat pulldown exercise shown in FIG. 7 and further details are omitted for the sake of brevity.

Figure 11:
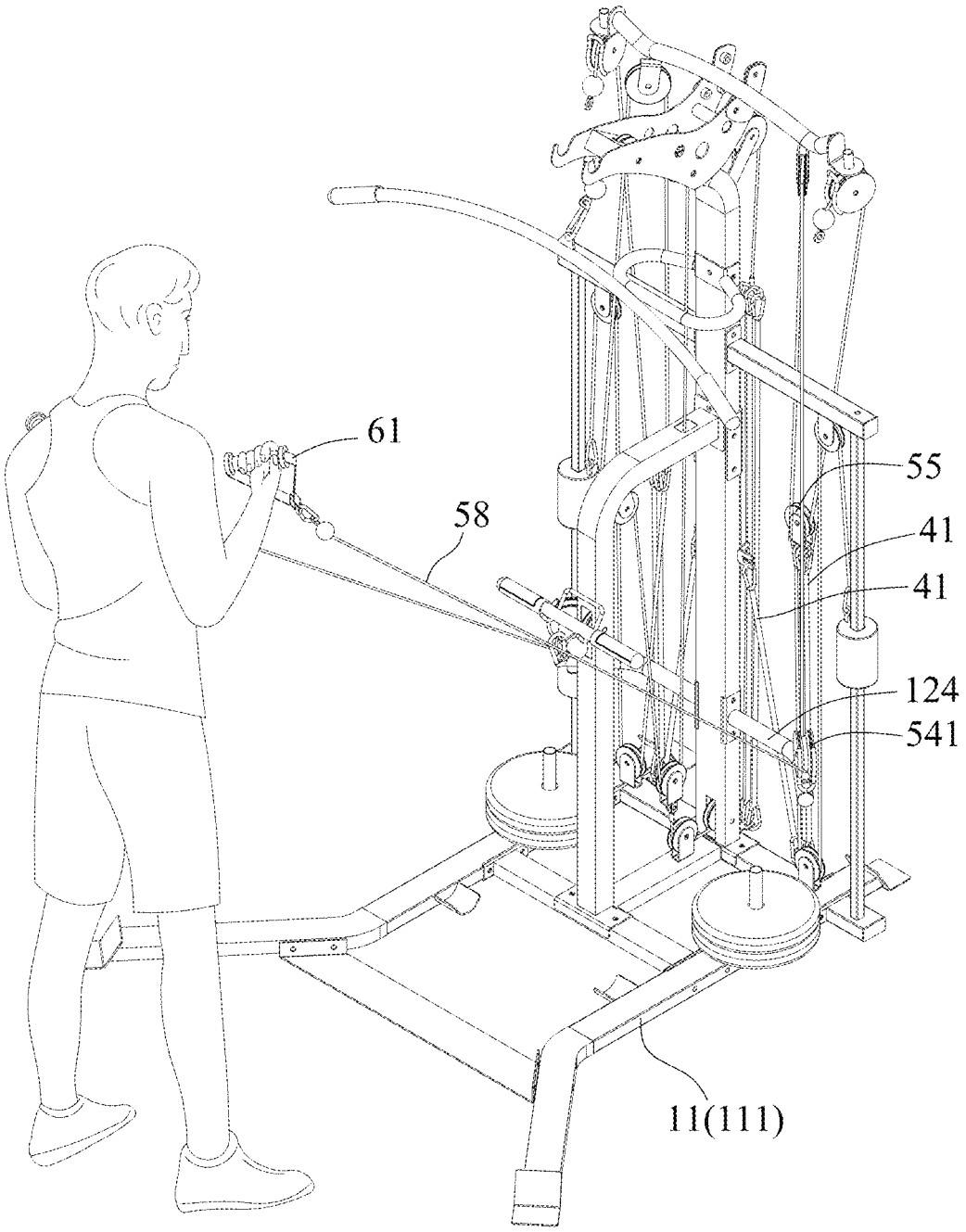
FIG. 11 is a schematic perspective view showing the user performing a standing low pulley bicep curl exercise on the embodiment.

Referring to FIG. 11, where the user is shown performing a standing low pulley bicep curl. In this case, the seat unit 20 is detached from the main frame 10 and the user stands in the middle of the spaced-apart legs 111 of the base seat 11. The two hand grips 61 are respectively connected to the second ends of the two third cables 58, with the first ends of the third cables 58 being fixed. The user exerts a pulling motion that pulls the two third cables 58. The pulling of each of the third cables 58 will drive the side movable pulley sets 55 to move upwardly, thereby resulting in deformation of the second elastic units 40 against an elastic force of the second elastic units 40.

Figure 12:
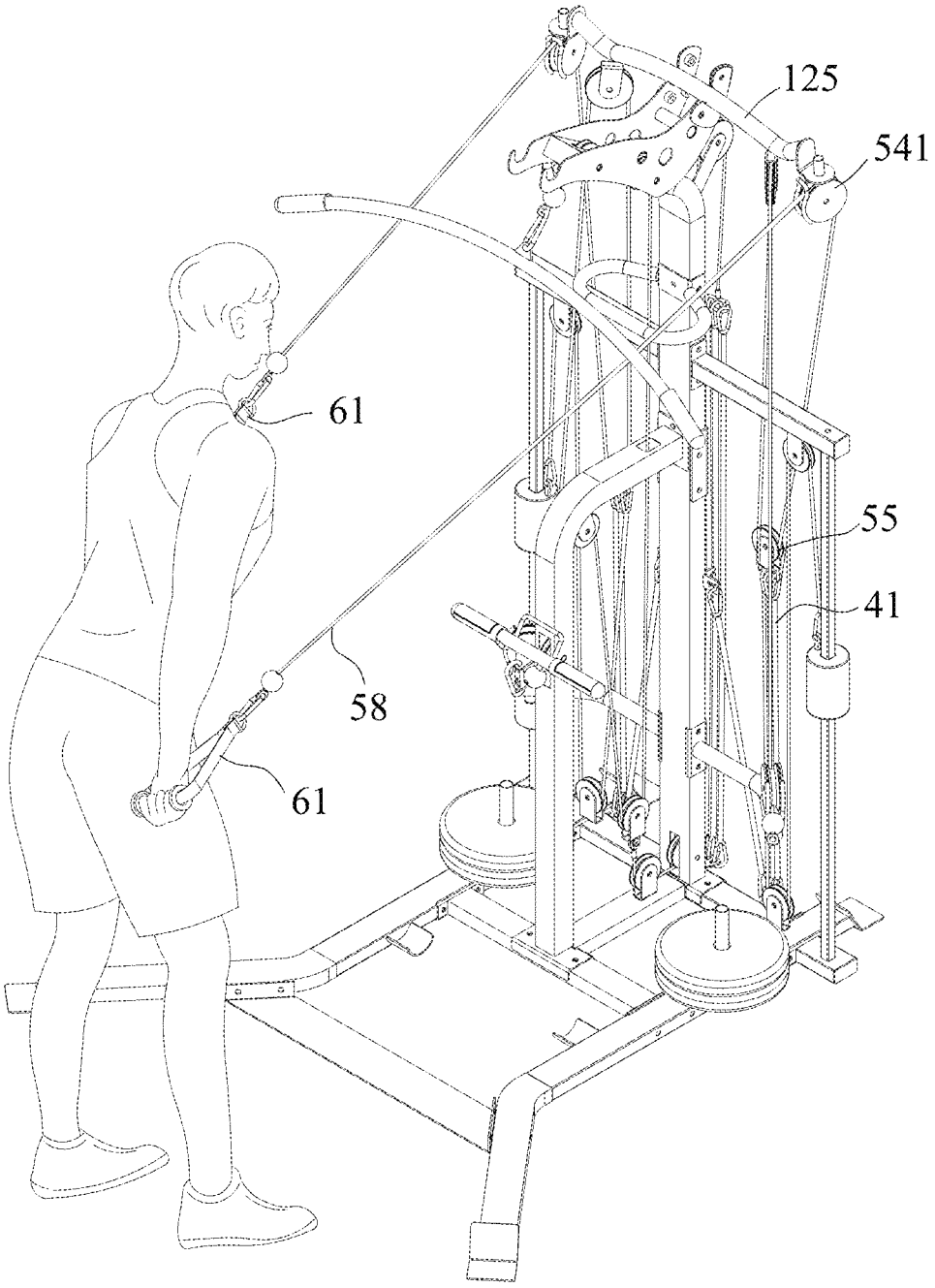
FIG. 12 is a schematic perspective view showing the user performing an alternating straight arm pulldown exercise on the embodiment.

Referring to FIG. 12, where the user is shown performing an alternating straight arm pulldown exercise. For this exercise the fitness exercise apparatus is set up by detaching the seat unit 24 from the main frame 10, and then respectively connecting the two hand grips 61 to the first ends of the two third cables 58, with the second ends of the third cables 58 being fixed. The user performs a pulling motion with the two hand grips 61 thereby pulling the two third cables 58. The pulling of each of the third cables 58 drives the respective one of the side movable pulley sets 55 to move upwardly, thereby resulting in deformation of the respective one of the second elastic units 40 against an elastic force of the second elastic units 40. Additionally, it should be noted that a standing straight arm pulldown exercise may be performed from the same setup of the fitness exercise apparatus.

Figure 13:
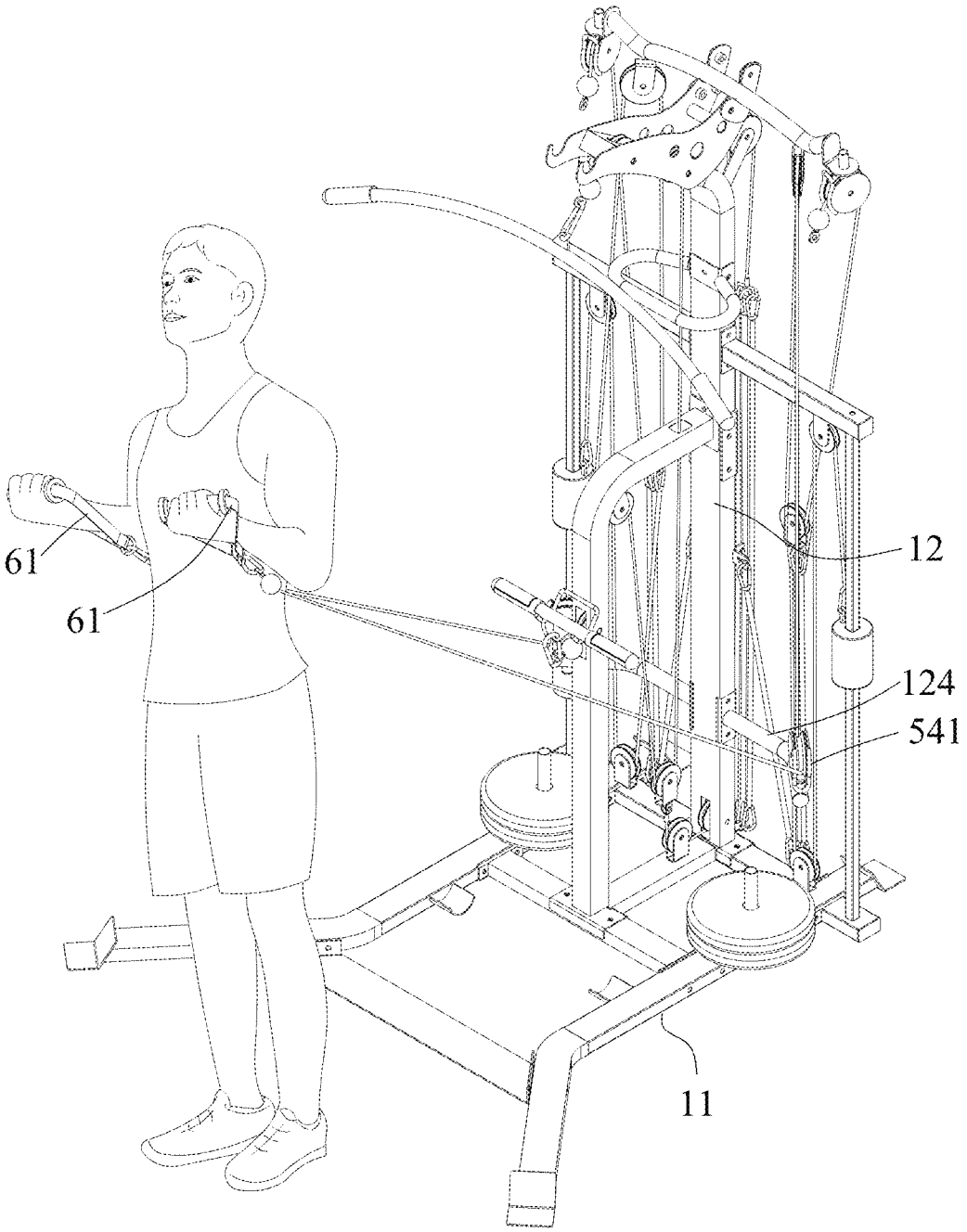
FIG. 13 is a schematic perspective view illustrating the user performing a reverse standing low pulley bicep curl exercise on the embodiment.

Referring to FIG. 13, in this setup the user is standing with their back facing the fitness exercise apparatus and performing a reverse low pulley standing bicep curl exercise. The two hand grips 61 are respectively connected to the second ends of the third cables 58 with the first ends of the third cables 58 being fixed.

Figure 14:
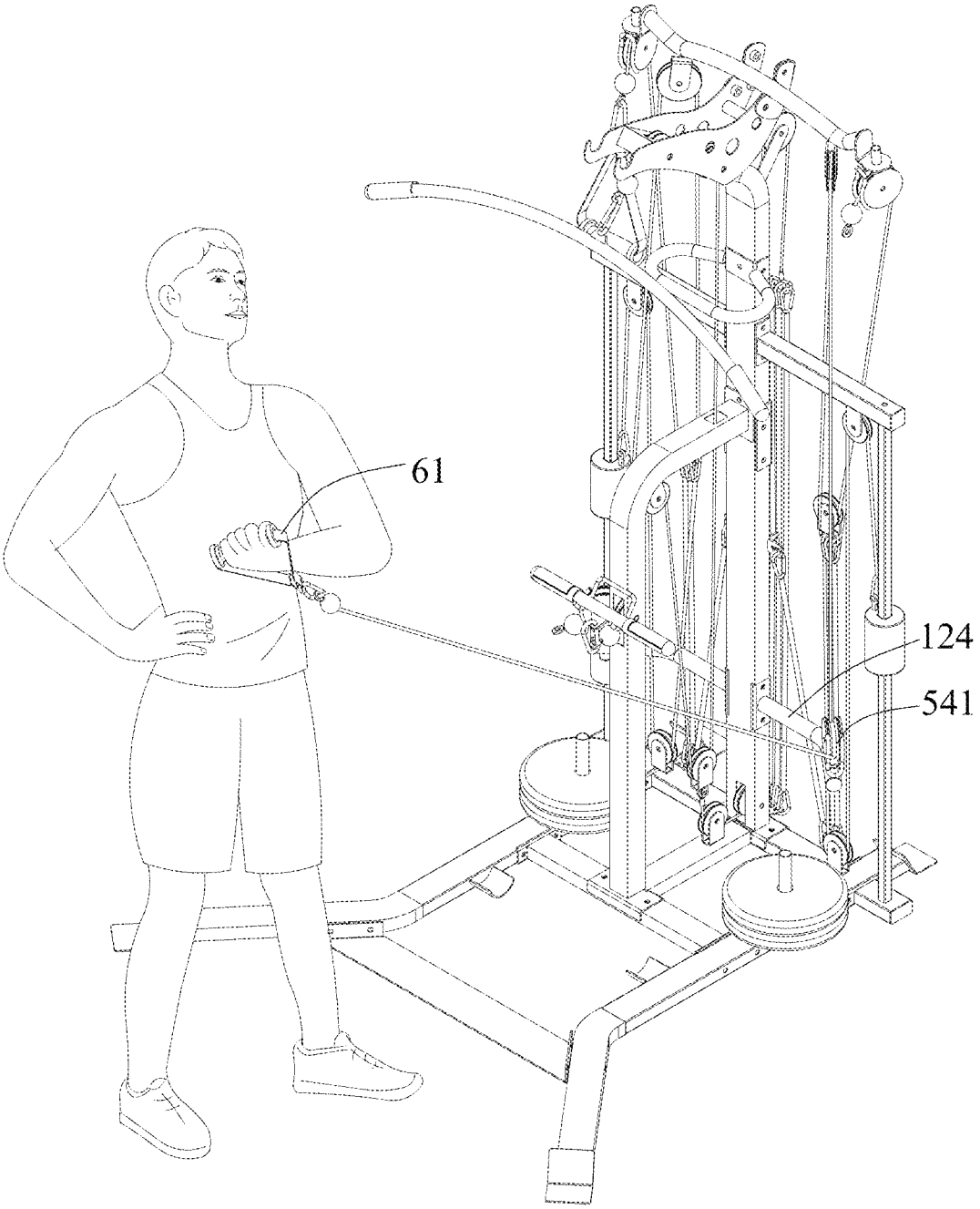
FIG. 14 is a schematic perspective view showing the user performing a cross body bicep curl exercise on the embodiment.

Referring to FIG. 14, the user is shown performing a cross body bicep curl exercise. The user stands sideways relative to the main frame 10 of the fitness exercise apparatus and performs a pulling motion using only a single hand grip 61 that is connected to the second end of one of the third cables 58.

Figure 15:
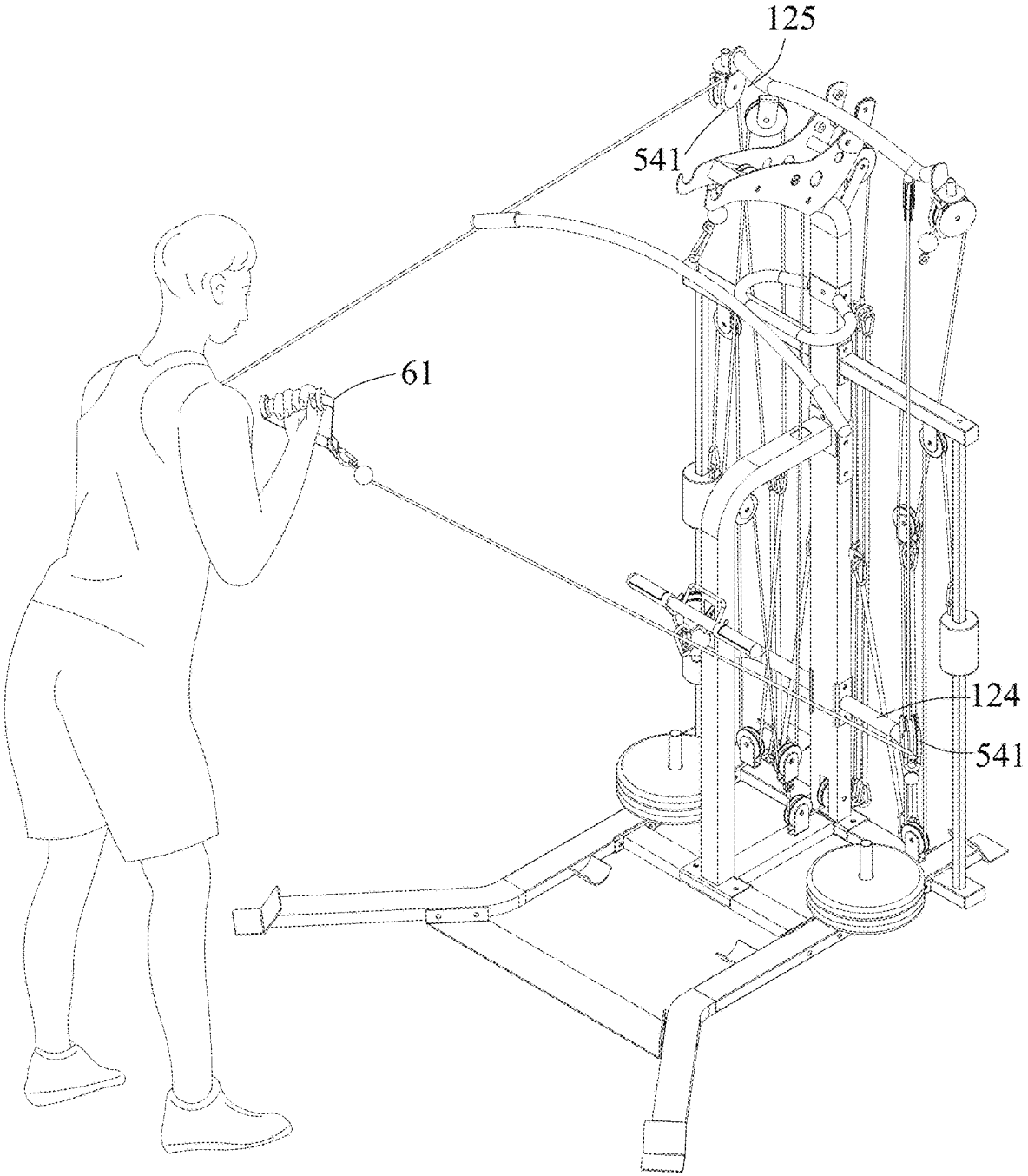
FIG. 15 is a schematic perspective view showing the user performing standing high and low cable crossover exercise on the embodiment

Referring to FIG. 15, the user is shown performing a standing high and low cable crossover exercise, where the user pulls the two hand grips 61 from a higher angle and a lower angle, to crossover at chest height. For this exercise one of the two hand grips 61 is connected to the first end of one of the third cables 58, and the other one of the two hand grips 61 is connected to the second end of the other one of the third cables 58.

Figure 16:
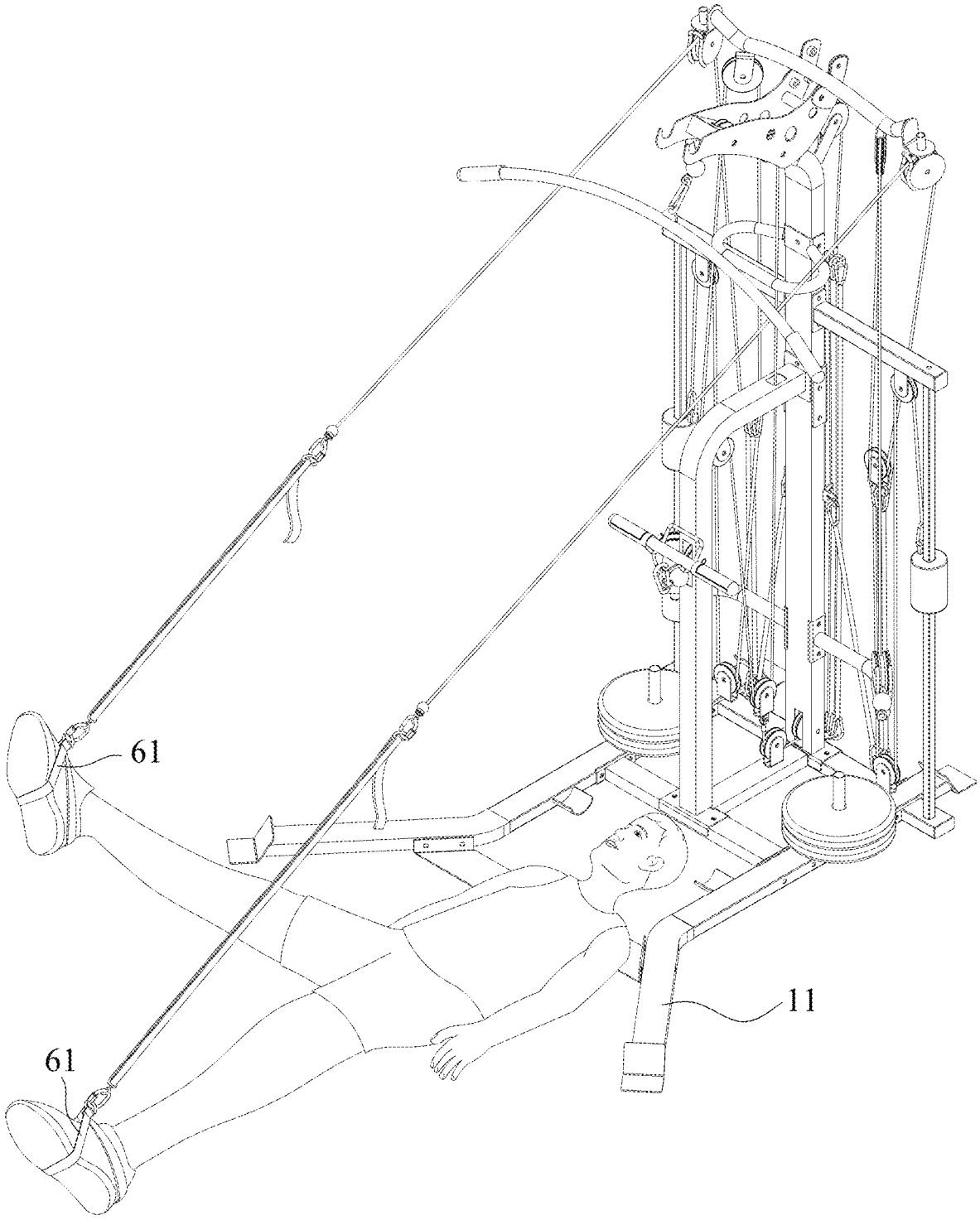
FIG. 16 is a schematic perspective view illustrating the user performing an alternating leg drop exercise on the embodiment.

Referring to FIG. 16, the user is shown performing an alternating leg drop exercise. For this exercise, the fitness exercise apparatus is setup the same as for the chest pull exercise, and the user uses the hand grips 61 as foot straps.

Figure 17:
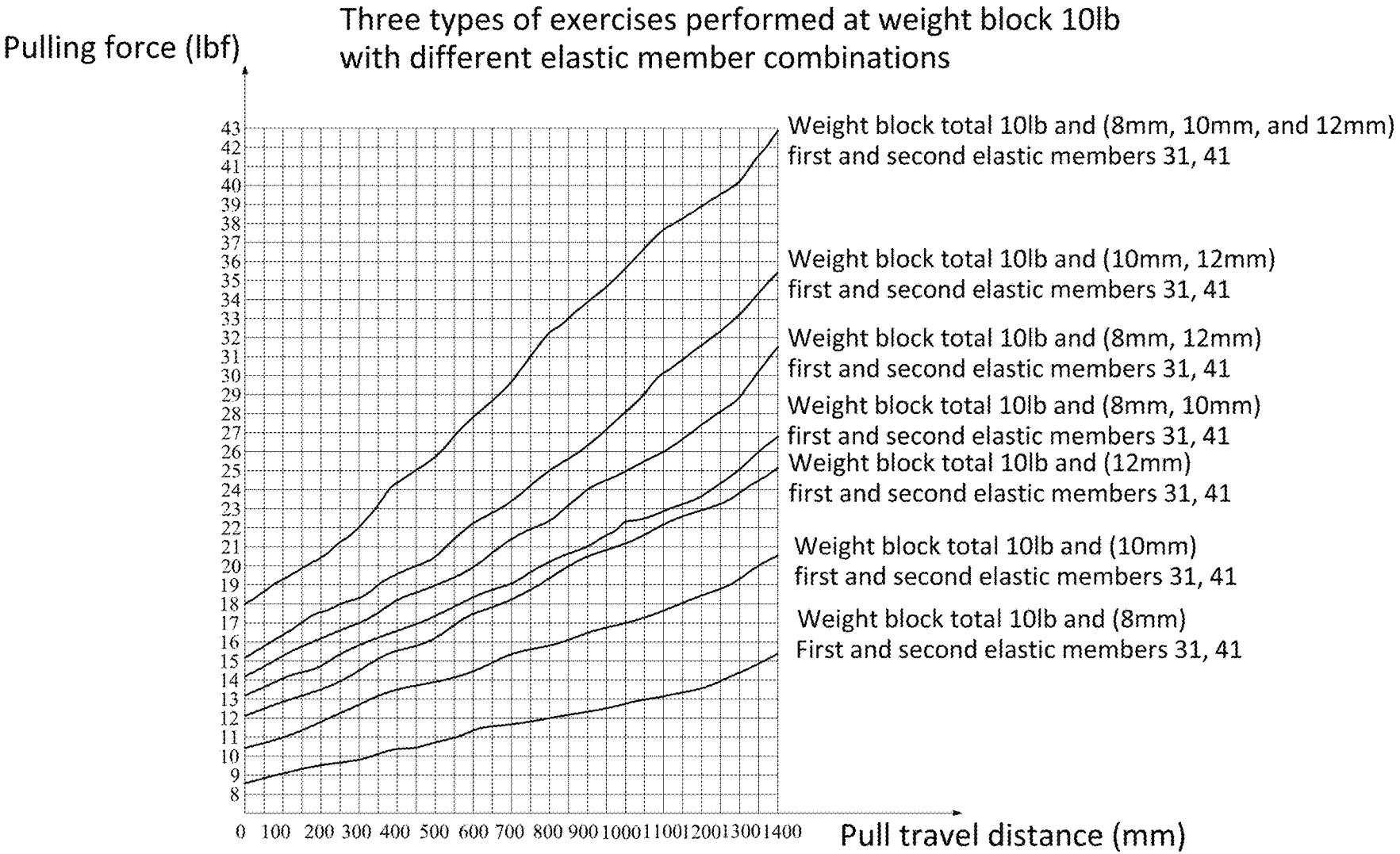
FIG. 17 is a force distance graph of 10 lb test results from exercises performed with the embodiment.
Figure 18:
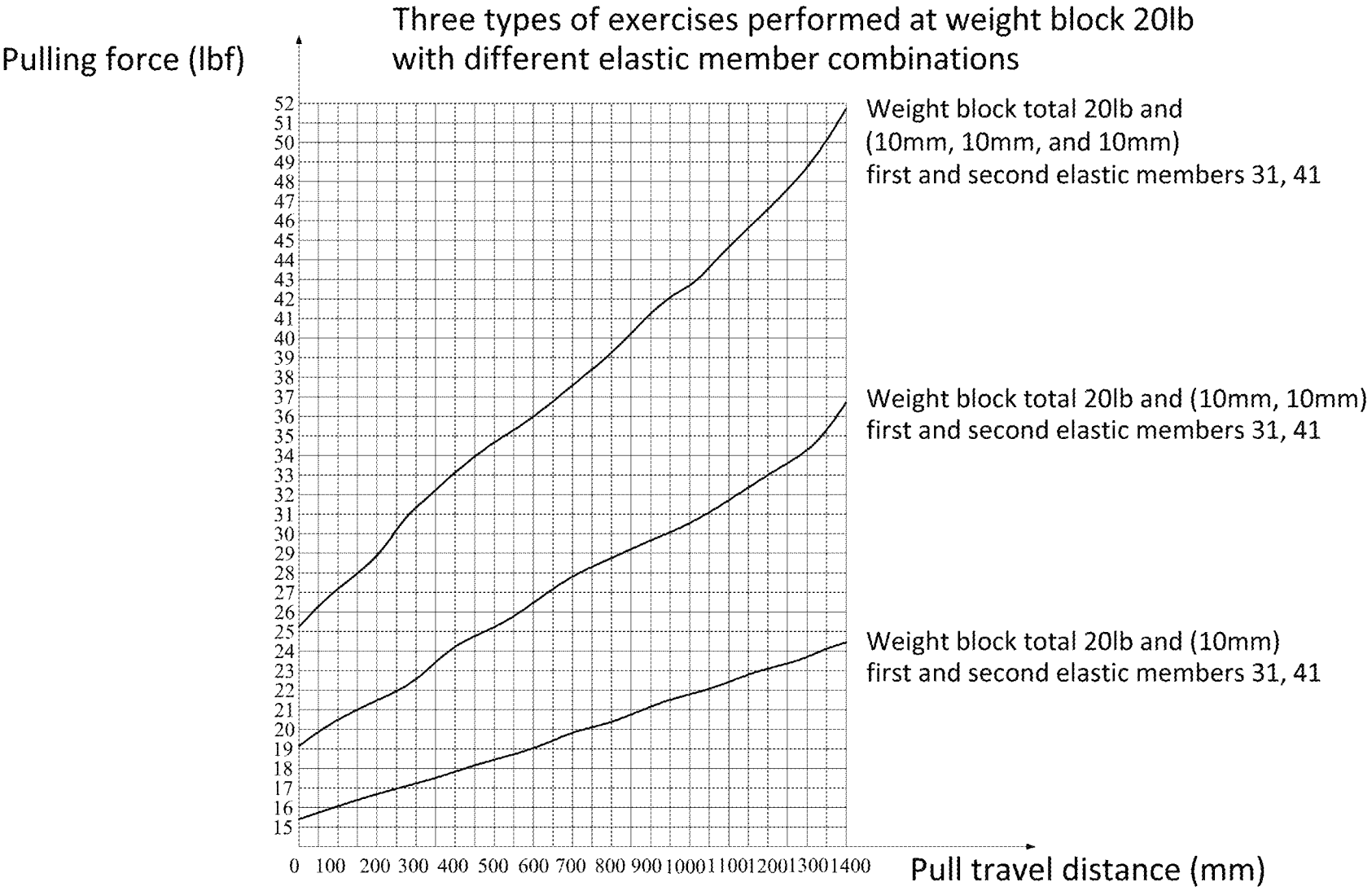
FIG. 18 is a force distance graph of 20 lb test results from exercises performed with the embodiment.
Figure 20:
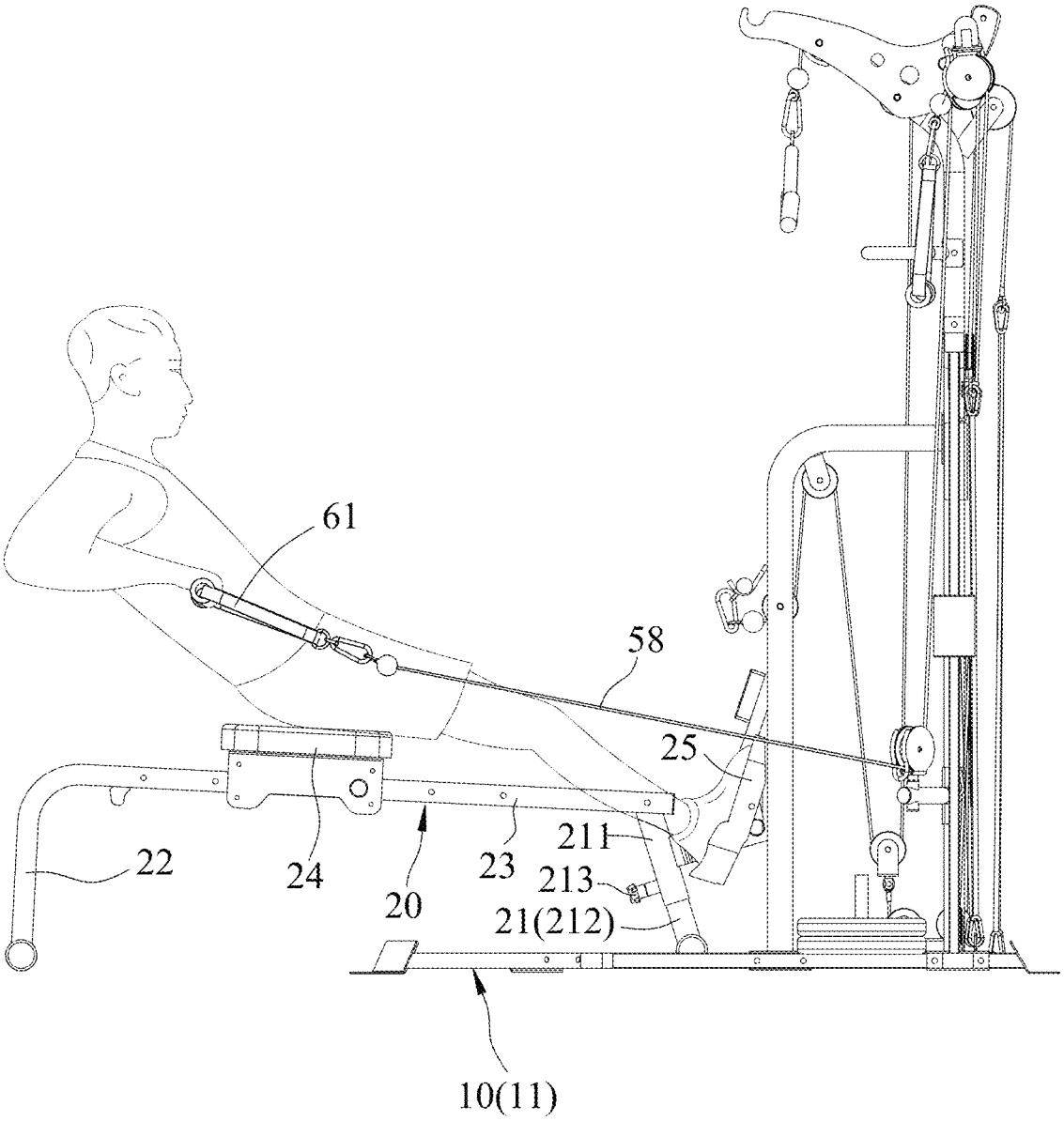
FIG. 20 is a schematic side view showing the user using the embodiment at a declined angle.

The fitness exercise apparatus according to the present disclosure has the following advantages:

1. The fitness exercise apparatus is operated against the elastic force of the first elastic members 31 and the second elastic members 41 by virtue of the combination of the main movable pulley set 53, the two side movable pulley sets 55, the first cable 56, the second cable 57, and the third cables 58. This structure has two notable advantages. The first one is that this structure is designed to avoid contact between the elastic members and the pulleys, which thereby prevents friction and prolongs the service life of the elastic members. Secondly, the first and second elastic members 31, 41 may have a linear deformation of up to 1.4 meters, allowing for 1.4 meters of travel for the user when operating the fitness exercise apparatus. The fitness exercise apparatus is thus applicable for a large range of users, and suitable for users with height up to 1.9 meters.
2. The first elastic unit 30 and the two second elastic units 40 form the resistance generating elements of the fitness exercise apparatus (while static resistance is provided by the weight blocks 82). In the exemplary embodiment of the disclosure, the first elastic unit 30 includes three first elastic members 31, and the two second elastic units 40 each include three second elastic members 41. The three first and second elastic members 31, 41 respectively have diameters of 8, 10, and 12 mm. By choosing different combinations of the three first and second elastic members 31, 41 the user may be provided with seven different resistance levels to perform over 20 different strength training and rowing machine exercises on the fitness exercise machine. Referring to FIGS. 17 and 18, a force distance plots is shown where 10 lb and 20 lb weight blocks 82 are used in combination with 8 mm, 10 mm, and 12 mm diameter first and second elastic members 31, 41 while performing three different types of exercises. The exercises are categorized in into three types, full stroke pulling exercises such as the wide grip lat pulldown exercise and the triceps pushdown exercise, and rowing machine exercises, two handed exercises such as the alternating straight arm pull down exercise and the chest pull exercise, and arm swing exercises such as the reverse standing low pulley bicep curl exercise. The results in FIGS. 17 and 18 show that the fitness exercise apparatus has the capacity to be used by a variety of users with different resistance preferences and that a variety of different exercises may be performed with the fitness exercise apparatus.
3. By designing the seat unit 20 to be a detachable bench, the structure of the seat unit 20 may be streamlined to lower costs. The detachability of the seat unit 20 also has the benefit of providing easier storage for the fitness exercise apparatus.
4. The seat unit 20 is mounted to the base seat 11 through its sheer weight alone without complicated mechanisms of attachment, which simplifies removal, storage and operation of the fitness exercise. Additionally, removing the seat unit 20 may allow the user to perform several exercises that require the user to stand right next to the fitness exercise
5. The structure of the seat unit 20 is simplified compared to the conventional exercise machine by not having complicated cable connections underneath the seat unit 20. Therefore, the seat unit 20 may be detached or re-attached quickly and making it easier for the user to perform various exercises. Additionally, production costs may be lowered due to the simpler attachment.
6. FIG. 20 shows the fitness exercise apparatus used in a manner similar to a two handle rowing machine by a user. The fitness exercise apparatus has the advantage in that it can be used for two styles of indoor rowing exercises. Additionally, the length of the inner leg member 21 of the seat unit 20 is adjustable so that the angle of the guide rail 23 may easily adjusted to be flat, inclined or declined. When the guide rail 23 is adjusted to be flat, the fitness exercise apparatus is suitable for bench training, and the guide rail 23 may be adjusted to be inclined to increase resistance for indoor rowing. Moreover, the seat unit 20 may be detached and removed in exercises where the user needs to stand right next to the fitness exercise apparatus.

Figure 19:
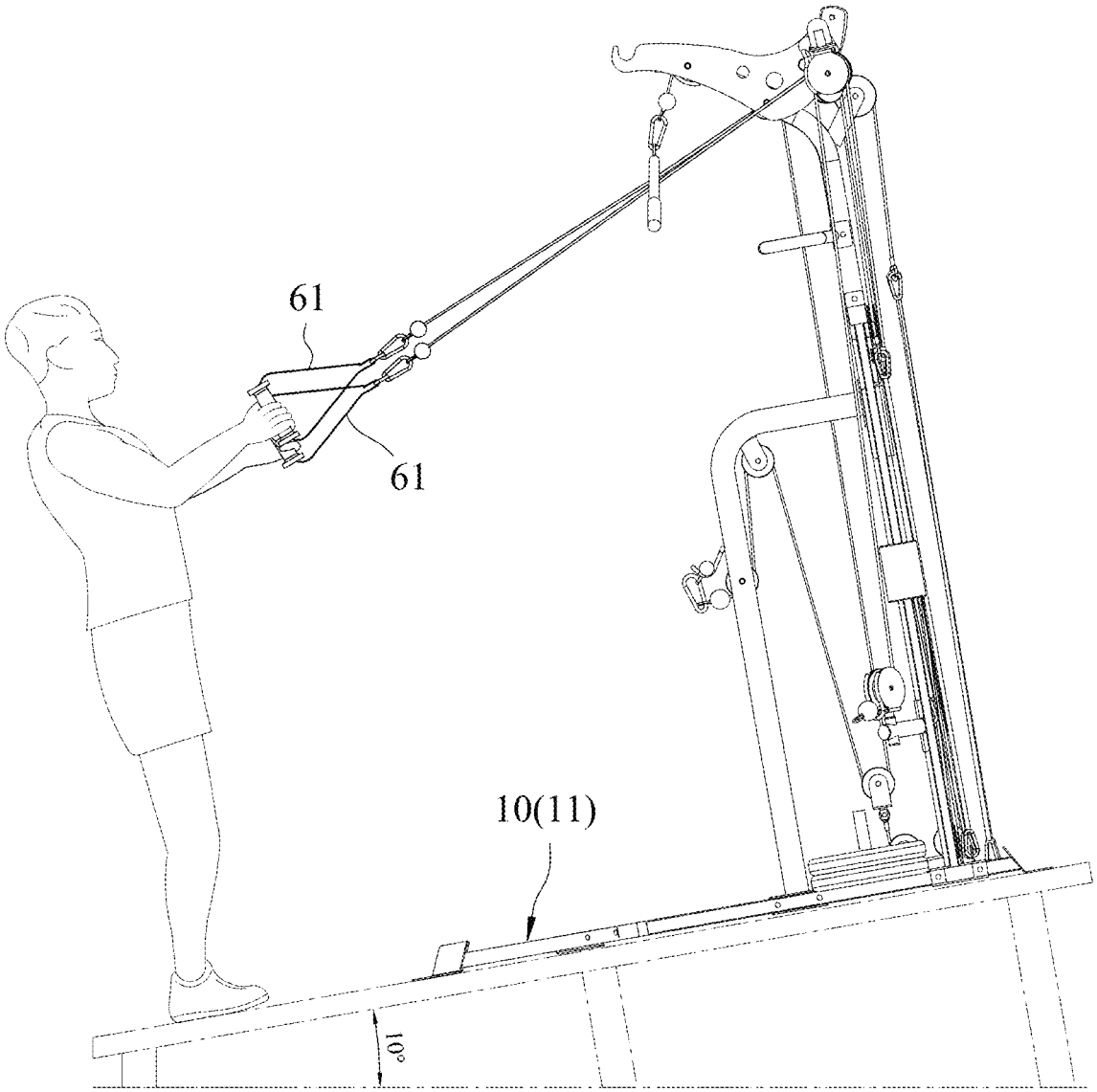
FIG. 19 is a schematic side view illustrating the user using the embodiment at an inclined angle.

7. By designing the seat unit 20 to be detachable, the fitness exercise apparatus is easier to manufacture, while also lowering the cost of manufacture. The detachable seat unit 20 is easier to package and ship, and can achieve 50% more shipping container utilization, which may translate to huge cost savings during periods of high inflation and high shipping costs.
8. Referring to FIGS. 1 and 19, the base seat 11 of the main frame has a flared design so that the fitness exercise apparatus is more stable. The fitness exercise apparatus complies with European standards EN957-2 test methods for stationary training equipment under test conditions of an incline of 10° a total of nine first elastic members 31 and second elastic members 41 stretched to a maximum limit.
9. The base seat 11 includes two offset weight units 70 disposed on opposite sides of the base seat 11. The user may freely add the weight plates 72 as a counterweight to increase the stability of the main frame 10 and prevent the main frame 10 from toppling over. The recommended amount of counterweight is 20 lbs on each side of the base seat 11 so as to comply with European standards EN957-2.
10. The first elastic unit 30 and the two second elastic units 40 form the resistance generating elements of the fitness exercise apparatus. In the exemplary embodiments of the disclosure, the first elastic unit 30 includes three first elastic members 31 and the two second elastic units 40 each include three second elastic members 41. The three first and second elastic members 31, 41 respectively have diameters of 8, 10, and 12 mm. By choosing different combinations of the three first and second elastic members 31, 41 the user may be provided with various different resistance levels to perform over 20 different strength training and rowing machine exercises on the fitness exercise machine.
11. Although the fitness exercise apparatus according to the present disclosure has the functionality of both cardio and strength training exercise equipment, it is more geared towards cardio workouts.
12. The seat member 24 is adjustable by the latch unit 26 engaging different securing holes 231 on the guide rail 23. This allows the fitness exercise apparatus to accommodate the requirements of different users ergonomically.

Figure 21:
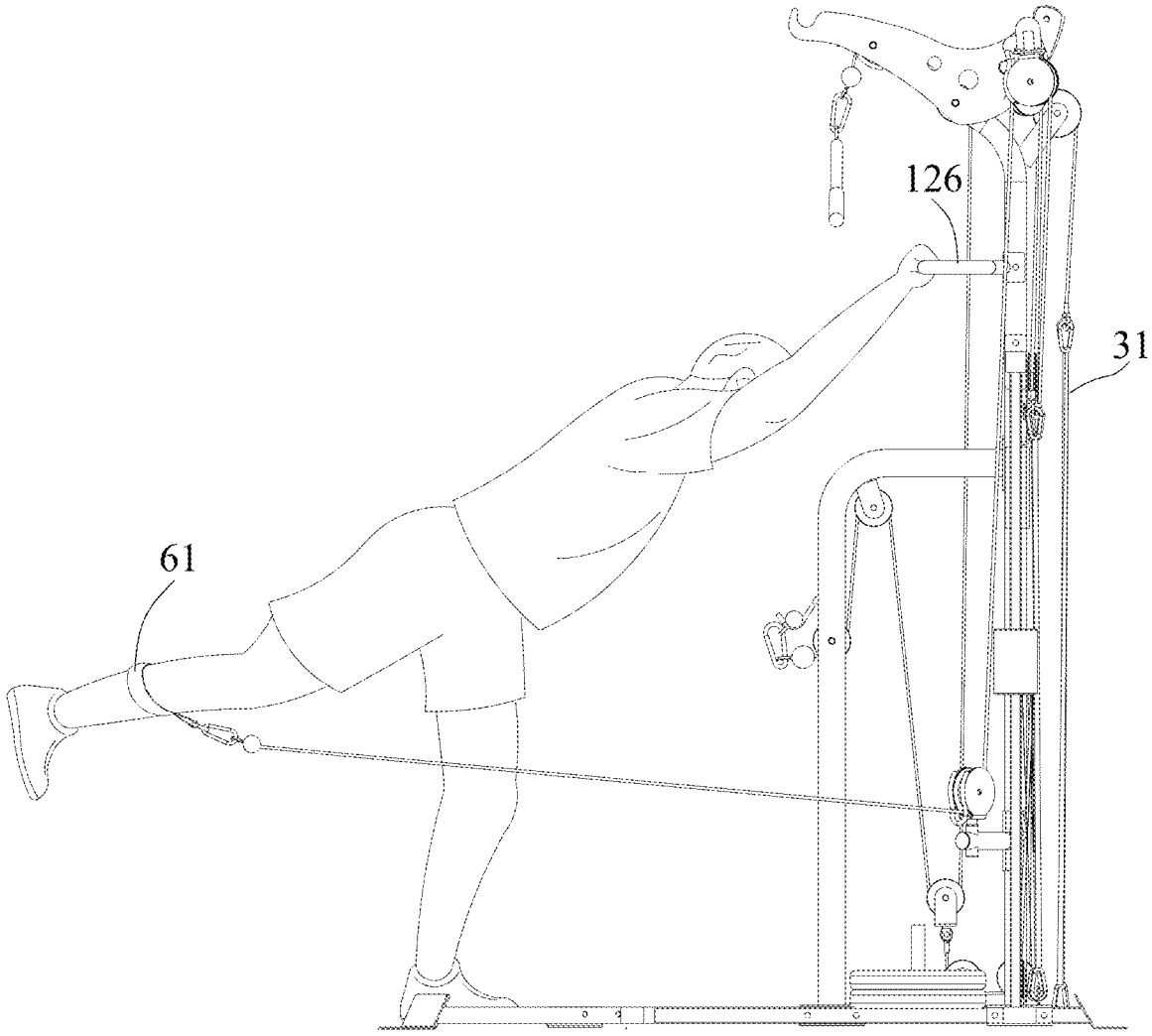
FIG. 21 is a schematic side view illustrating the user performing a cable glute kickback exercise on the embodiment.

Referring to FIG. 1, a conventional rowing machine display and sensor 61 is installed on the seat unit 20, a phone holder 62 is installed on the support unit 12, and sensors 521, 531 are installed respectively on the long handlebar 62 and the short handlebar 63. These instruments allow the fitness exercise apparatus to display various exercise data such as laps/repetitions, speed, calorie expenditure, and heart rate so that the user may monitor their training progress and analyze their progress quantitatively. This may increase user motivation and incentivize the user to accomplish their fitness goals. The user may monitor their calorie expenditure and their heart rate from the conventional rowing machine display and sensor 61. Referring to FIG. 21, the user is shown performing a cable glute kickback exercise where the support handle 126 may be used for support and the operating member may be an ankle strap.

In summary of the above, the fitness exercise apparatus according to the disclosure has the functions of both cardio and strength training exercise machines. The structure is simple, and the manufacture process may be streamlined. The fitness exercise apparatus allows users to quickly reach their strength training as well as cardio fitness goals.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is(are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A fitness exercise apparatus comprising:

a main frame including a base seat and a support unit that is connected to said base seat;

a seat unit mounted detachably on said base seat;

a first elastic unit mounted on said main frame and including a plurality of first elastic members;

two second elastic units mounted on said main frame, each of said second elastic units including a plurality of second elastic members;

a transmission unit including a first fixed pulley set that is mounted on said support unit, a second fixed pulley set that is mounted on said support unit, a main movable pulley set, two third fixed pulley sets that are mounted on said support unit, two side movable pulley sets that are connected respectively to said second elastic units, a first cable that wraps around said first fixed pulley set and said main movable pulley set, a second cable that wraps around said second fixed pulley set and said main movable pulley set, and that is connected to said first elastic unit, and two third cables, each wrapping around a respective one of said third fixed pulley sets and a respective one of said side movable pulley sets; and an operating unit including at least one operating member that is connected to one of said first, second and two third cables;

wherein pulling of said first cable drives said main movable pulley set to move upwardly, thereby resulting in, via said second cable, deformation of said first elastic unit against an elastic force of said first elastic unit; and wherein pulling of each of said third cables drives the respective one of said side movable pulley sets to move upwardly, thereby resulting in deformation of the respective one of said second elastic units against an elastic force of said second elastic unit.

2. The fitness exercise apparatus of claim 1, further comprising two resistance units, each including a weight block that is mounted on said main frame, and a connecting cable that interconnects said weight block and a respective one of said side movable pulley sets, pulling of each of said third cables driving the respective one of said side movable pulley sets to move upwardly, thereby resulting in movement of said weight block of the respective one of said resistance units.

3. The fitness exercise apparatus of claim 2, wherein:

said support unit of said main frame includes a rear support member that is inverted L-shaped, a front support member that is connected between said rear support member and said base seat and that is inverted L-shaped, a hanging member that is mounted on a top of said rear support member, two lower mounting rods that are connected respectively to opposite lateral sides of said rear support member, an upper mounting rod that is mounted on said hanging member, two horizontal rods that are connected respectively to said opposite lateral sides of said rear support member, and two guide rods, each guide rod having one end that is connected to said base seat, and an opposite end that is connected to a respective one of said horizontal rods;

said first fixed pulley set of said transmission unit includes a plurality of first fixed pulleys that are mounted to said rear support member, said front support member, and said hanging member;

said second fixed pulley set of said transmission unit includes a plurality of second fixed pulleys that are mounted respectively to said rear support member and said base seat;

said third fixed pulley set of said transmission unit includes a plurality of third fixed pulleys mounted on said upper mounting rod and said lower mounting rods;

each of said resistance units further includes a fourth fixed pulley set that is mounted on said main frame, and that includes two fourth fixed pulleys mounted respectively one a respective one of said horizontal rods and said base seat; and for each of said resistance units, a respective connecting cable wraps around a respective set of fourth fixed pulleys, and a respective weight block is sleeved slidably on the respective one of said guide rods.

4. The fitness exercise apparatus of claim 3, wherein:

said main movable pulley set of said transmission unit includes a main block, and a main movable pulley fixed on said main block;

said first cable wraps around said main movable pulley; and said second cable is connected to said main block.

5. The fitness exercise apparatus of claim 3, wherein:

each of said side movable pulley sets of said transmission unit includes a side block and a side movable pulley that is fixed on said side block;

for each of said second elastic units, said second elastic members are connected detachably to said side block of a respective one of said side movable pulley sets; and said connecting cable of each of said resistance units has one end connected to said side block of a respective one of said side movable pulley sets, and an opposite end connected detachably to said weight block.

6. The fitness exercise apparatus of claim 1, wherein:

said base seat includes two spaced-apart legs, a plurality of connecting rods that are connected between said legs, and two retaining members that are connected fixedly and respectively to said legs; and said seat unit includes an inner leg member that is coupled removably to said retaining members, an outer leg member, a guide rail that is connected between said inner leg member and said outer leg member, and a seat member that is mounted on said guide rail.

7. The fitness exercise apparatus of claim 6, wherein:

said inner leg member of said seat unit includes a stationary tube that is connected transversely to said guide rail, an inner leg rod that is connected telescopically to said stationary tube and that is formed with a plurality of adjusting holes, and an adjusting component that is inserted transversely into said stationary tube and that engages a selected one of said adjusting hole; and said inner leg rod is inverted T-shaped, and has two arms coupled removably and respectively to said retaining members of said base seat.

8. The fitness exercise apparatus of claim 7, wherein each of said legs of said base seat has:

a base segment; and an inclined segment that is transverse to said base segment, that has an inner end connected to said base segment, and an outer end opposite to said inner end, a distance between said inclined segments of said legs gradually increasing from said inner ends of said inclined segments toward said outer ends of said inclined segments.

9. The fitness exercise apparatus of claim 7, further comprising two weight units, each including a shaft that is secured to said base seat, and a plurality of weight plates that are sleeved removably on said shaft.

* * * * *